US007869754B2

(12) United States Patent
Katano et al.

(10) Patent No.: US 7,869,754 B2
(45) Date of Patent: Jan. 11, 2011

(54) BUBBLE CREATING METHOD, BUBBLE CREATING DEVICE, BUBBLY FIXATION FLUID PRODUCING METHOD, BUBBLY FIXATION FLUID PRODUCING DEVICE, FIXATION FLUID, IMAGE FORMING METHOD, AND IMAGE FORMING APPARATUS

(75) Inventors: Yasuo Katano, Kanagawa (JP); Tsuneo Kurotori, Tokyo (JP); Tomoyasu Hirasawa, Kanagawa (JP); Takuma Nakamura, Kanagawa (JP); Yuko Arizumi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 359 days.

(21) Appl. No.: 12/068,495

(22) Filed: Feb. 7, 2008

(65) Prior Publication Data

US 2008/0213002 A1 Sep. 4, 2008

(30) Foreign Application Priority Data

Feb. 9, 2007 (JP) ..... 2007-029903

(51) Int. Cl.
*G03G 15/20* (2006.01)

(52) U.S. Cl. ..... 399/340

(58) Field of Classification Search ..... 399/320, 399/340; 219/216; 347/156; 430/97; 366/348
See application file for complete search history.

(56) References Cited

U.S. PATENT DOCUMENTS 5,314,644 A 5/1994 Michelsen et al.
5,845,993 A * 12/1998 Shirtum et al. ..... 366/348
7,046,952 B2 * 5/2006 Kurotori et al. ..... 399/340
2004/0131402 A1 7/2004 Kurotori et al.

FOREIGN PATENT DOCUMENTS

| | | |
|---|---|---|
| EP | 1 510 246 | 3/2005 |
| JP | 59-119364 | 7/1984 |
| JP | 07-044034 | 2/1995 |
| JP | 2002-03724 | 1/2002 |
| JP | 2002-59188 | 2/2002 |
| JP | 2002-95943 | 4/2002 |
| JP | 2004-109747 | 4/2004 |
| JP | 2004-109749 | 4/2004 |
| WO | WO 2007-094245 | 8/2007 |

OTHER PUBLICATIONS

Search Report dated Jun. 11, 2008 for corresponding European Application No. 08250466.3-1240.

* cited by examiner

*Primary Examiner*—Hoan Tran
(74) *Attorney, Agent, or Firm*—Harness, Dickey & Pierce, P.L.C.

(57) ABSTRACT

A bubbly fluid producing method configured to produce a bubbly fluid containing a bubble with a desired bubble diameter, includes applying a shear to a bubbly fluid containing a bubble with a bubble diameter larger than a desired bubble diameter so as to produce a bubbly fluid containing a bubble with a desired bubble diameter. A bubbly fluid producing device configured to produce a bubbly fluid containing a bubble with a desired bubble diameter, includes a first member configured to apply a shear to a bubbly fluid containing a bubble with a bubble diameter larger than a desired bubble diameter so as to produce a bubbly fluid containing a bubble with a desired bubble diameter.

15 Claims, 11 Drawing Sheets

BUBBLE CREATING METHOD, BUBBLE CREATING DEVICE, BUBBLY FIXATION FLUID PRODUCING METHOD, BUBBLY FIXATION FLUID PRODUCING DEVICE, FIXATION FLUID, IMAGE FORMING METHOD, AND IMAGE FORMING APPARATUS

BACKGROUND OF THE INVENTION

1. Field of the Invention

The present invention relates to a bubble creating method, a bubble creating device, a bubbly fixation fluid producing method, a bubbly fixation fluid producing device, a fixation fluid, an image forming method, and an image forming apparatus.

2. Description of the Related Art

An image forming apparatus such as printers, facsimile machines and copying machines is an apparatus for forming an image including a character or a symbol on a recording medium such as paper, cloth and OHP sheets based on image information. Particularly, electrophotographic image forming apparatuses have been widely used in offices since a high definition image can be formed on a normal paper sheet at a high speed. In such an electrophotographic image forming apparatus, a thermal fixation method has been widely used in which toner is fixed on a recording medium by heating and melting the toner on the recording medium and pressurizing the melted toner. The thermal fixation method has been used preferably since there may be provided, for example, a high fixation speed and a high fixed-image quality.

However, about half or more of electric power consumption in such an electrophotographic image forming apparatus may correspond to consumptions for heating toner in the thermal fixation method. Meanwhile, a fixation device with a low electric power consumption (energy saving) is desired from the viewpoint of dealing with environmental problems in recent years. That is, a fixation method is desired which is not required to lower a toner-heating temperature extremely than ever or heat toner so as to fix the toner. Particularly, a non-heating fixation method for fixing toner on a recording medium without heating the toner at all is ideal in terms of low electric power consumption.

For such a non-heating fixation method, for example, a wet-type toner fixation method is proposed in Japanese Patent No. 3,290,513 in which a oil-in-water-type fixing agent capable of dissolving or swelling toner in which an organic compound insoluble or hard to be dissolved in water is dispersed in and mixed into water is sprayed or dropped onto the surface of a substrate on which unfixed toner is arranged at predetermined positions so as to dissolve or swell the toner and subsequently the substrate is dried.

However, since an oil-in-water-type fixing agent in which an organic compound insoluble or hard to be dissolved in water is dispersed and mixed in water is used in the wet-type fixation method in Japanese Patent No. 3,290,513, the water content of the fixing agent may be absorbed into a recording medium (substrate) such as transfer paper sheets and cockle or curl may be generated in the recording medium when a large quantity of the fixing agent is applied on unfixed toner. Accordingly, stable and high-speed delivery of recording medium which is required for an image forming apparatus may be deteriorated significantly. Then, if the water content of a fixing agent applied on a recording medium is removed by evaporating a large quantity of water contained in the fixing agent using a dryer, an electric power comparable to the electric power consumption of an image forming apparatus in which the thermal fixation method is used may be required.

Also, for a fixation fluid that does not repel a water-repellency treated and unfixed toner, some oily fixation fluids have been proposed conventionally in which a material for dissolving or swelling toner is dissolved in a oily solvent. For one example of them, a fixation fluid in which an aliphatic dibasic acid ester or the like as a material component for dissolving or swelling a resin component constituting a toner is diluted (or dissolved) by a non-volatile dimethylsilicone as a diluent (or solvent) is proposed in Japanese Patent Application Publication No. 2004-109749. Also, a solution for fixation of an unfixed toner image in a miscible condition which is obtained by mixing 8-120 parts by volume of a silicone oil with 100 parts by volume of a solvent dissolving a toner and having a miscibility with the silicone oil is proposed for a fixation solution that may be used for a fixation method capable of fixing an unfixed image formed by an electrostatic method on an image-receiving sheet clearly and easily without disturbing the image, in Japanese Patent Application publication No. S59-119364. Since such an oily fixation fluid contains an oily solvent having a high affinity with a water-repellency treated and unfixed toner, the water-repellency treated and unfixed toner may be dissolved or swelled without repelling the toner so as to fix the toner on a recording medium.

Any of Japanese Patent No. 3,290,513, Japanese Patent Application Publication No. 2004-109749 and Japanese Patent Application publication No. S59-119364 provides a configuration for applying a fluid on an unfixed toner layer. However, as shown in FIGS. 14A and 14B, when the thickness of a fixation fluid layer 4 on an application roller 1 is less than that of an unfixed toner layer 3 in order to provide a small amount of the fixation fluid on a recording medium 2 in the configuration for applying a fixation fluid on the unfixed toner layer 3 on the recording medium 2 by using the application roller 1 as a contact providing device, unfixed toner particles may be attracted by surface tension caused by a fluid film of the fixation fluid on a surface of the application roller 1 at a position where the application roller 1 leaves from the recording medium 2 and the toner particles may be offset to a surface of the application roller 1, so that an image on the recording medium 2 may be significantly disturbed. On the other hand, when the thickness of a fixation fluid layer 4 on an application roller 1 is sufficiently more than that of an unfixed toner layer 3 as shown in FIG. 15, surface tension caused by a fluid film on a surface of the application roller 1 may not easily and directly act on a toner particle due to a higher amount of the fluid at a position where the application roller 1 leaves from the recording medium 2 and a toner may not be offset to the roller side. However, since a higher amount of a fixation fluid is applied on a paper surface, the toner particles may be drifted by an excess amount of the fixation fluid on the recording medium 2 so that image deterioration may be caused or a drying time may be longer so that a problem may be caused in fixation responsiveness. Also, significant feel of remaining fluid on a paper sheet (wet feel when the paper sheet is touched) may be caused. Furthermore, when the fixing fluid contains water and its application amount on a cellulose-containing medium such as paper sheets is large, a recording medium such as paper sheets may be curled significantly so that jam of an apparatus such as image forming apparatuses may occur which may be caused by a recording medium such as paper sheets at the time of delivery of the recording medium in the apparatus.

Therefore, it may be extremely difficult to attain both application of a small amount of fixation fluid on a toner layer on a paper sheet for improvement of fixation responsiveness, reduction of feeling of remaining fluid and prevention of curling and prevention of toner offset to a fixation roller, in the configuration for conducting roller application of such a fixation fluid. Additionally, when a die coating device, a blade coating device or a wire bar coating device is used as a contact application device and the amount of a fixation fluid is small, toner may also be offset to the contact application device due to the surface tension.

As described above, it may be extremely difficult to attain both application of a small amount of a fixation fluid on a toner layer on a paper sheet for improving fixation responsiveness and uniform application without disturbing a toner image by a conventional formulation of a fixation fluid and a contact application device.

The inventors have conceived of an idea to provide a fixation fluid for a resin fine particle which may conduct fixation of a resin-containing fine particle such as a toner on a medium such as a paper sheet quickly after the fixation fluid may be applied on the medium to which the resin fine particle may be attached while no resin fine particle on the medium may be disturbed and to conduct application of its small amount such that no feel of remaining fluid on the medium may be caused, and a fixation method and fixation device and image forming method and image forming apparatus using the fixation fluid.

Also, the inventors have conceived of an idea to provide a bubbly fixation fluid producing method and device which may have a bubble with a diameter of a desired size during a short time period while a liquid fixation fluid may be used in a container.

SUMMARY OF THE INVENTION

According to one aspect of the present invention, there is provided a bubbly fluid producing method configured to produce a bubbly fluid containing a bubble with a desired bubble diameter, which comprises a step of applying a shear to a bubbly fluid containing a bubble with a bubble diameter larger than a desired bubble diameter so as to produce a bubbly fluid containing a bubble with a desired bubble diameter.

According to another aspect of the present invention, there is provided a bubbly fluid producing device configured to produce a bubbly fluid containing a bubble with a desired bubble diameter, which comprises a first member configured to apply a shear to a bubbly fluid containing a bubble with a bubble diameter larger than a desired bubble diameter so as to produce a bubbly fluid containing a bubble with a desired bubble diameter.

According to another aspect of the present invention, there is provided a bubbly fluid which is produced by the bubbly fluid producing method as described above.

According to another aspect of the present invention, there is provided a bubbly fluid which is produced by the bubbly fluid producing device as described above.

According to another aspect of the present invention, there is provided a fixation method configured to fix a particle on a medium, which comprises a step of providing the bubbly fluid as described above to the particle.

According to another aspect of the present invention, there is provided a fixation device configured to fix a particle on a medium, which comprises a member providing the bubbly fluid as described above to the particle.

According to another aspect of the present invention, there is provided an image forming method configured to form an image on a medium by using a particle, which comprises a step of fixing the particle on the medium by using the fixation method as described above.

According to another aspect of the present invention, there is provided an image forming apparatus configured to form an image on a medium using a particle, which comprises the fixation device as described above.

DETAILED DESCRIPTION OF THE PREFERRED EMBODIMENTS

An embodiment of the present invention relates to at least one of a bubble creating method, a bubble creating device, a bubbly fixation fluid producing method, a bubbly fixation fluid producing device, a fixation fluid, an image forming method, and an image forming apparatus. More particularly, an embodiment of the present invention may relate to a mechanism for making a diameter of a bubble in a bubbly fixation fluid for fixing a resin-containing fine particle on a medium be a desired bubble diameter.

Figure 1:
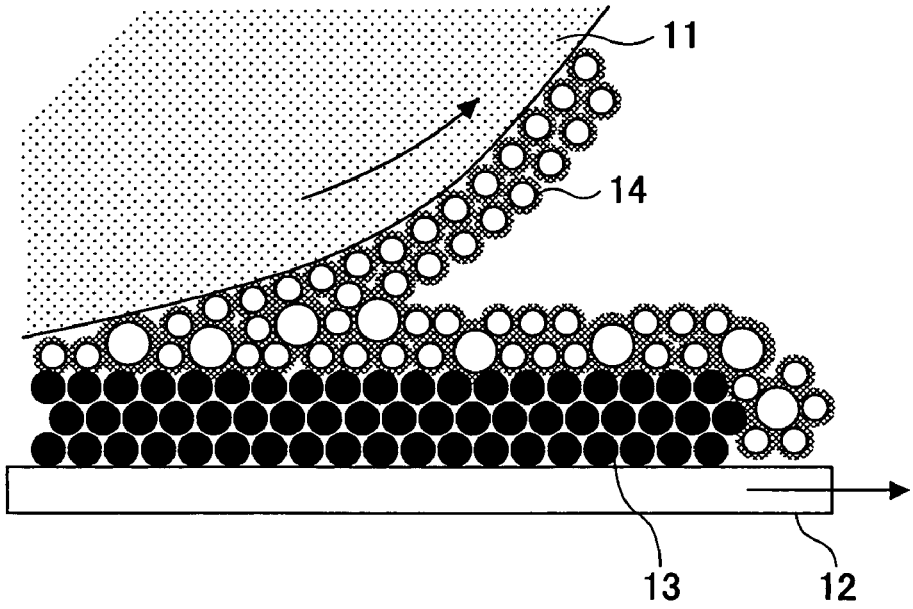
FIG. 1 is a schematic cross-sectional diagram showing a situation of fixation of resin-containing fine particles after application of a fixation fluid according to the principle of an embodiment of the present invention.
Figure 2:
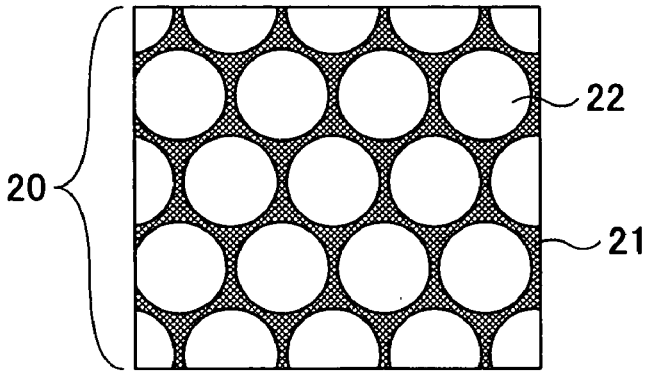
FIG. 2 is a schematic cross-sectional diagram showing the configuration of a bubbly fixation fluid.

First, the principle of an embodiment of the present invention will be outlined below. As shown in FIG. 1, it has been found that an embodiment of the present invention may prevent a resin fine particle from offsetting to an application roller 11, since a fixation fluid may be a bubbly fixation fluid 14 composed of a bubble by a bubbly fixation fluid producing part as described below, whereby the volume density of the fixation fluid may be reduced and the fluid thickness of the fixation fluid on the application roller 11 may be increased, and further an influence of the surface tension of the fixation fluid may be reduced. Furthermore, it has been found that the range of the diameter of a bubble in the bubbly fixation fluid 14 may be necessarily about 5 μm-about 50 μm in order to provide a resin fine particle layer 13 with the bubbly fixation fluid without disturbing the fine particle layer when the size of the resin fine particle is about 5 μm-about 10 μm. Additionally, as shown in FIG. 2, a bubbly fixation fluid 20 composed of a gas bubble 22 is composed of a fluid film boundary (referred to as a plateau boundary, below) 21 which separates the gas bubbles 22 from one another.

Meanwhile, it has been found that it takes several minutes to provide a desired bubble diameter of about 5 μm-about 50 μm where a container encapsulating a liquid fixation fluid is an article of replacement and consumption in a fixation device and agitation is conducted by, for example, rotational agitation with a wing-type stirrer, which is a representative agitation method, while a gas is involved, in a method for producing a bubbly fixation fluid having the desired range of bubble diameter from the liquid fixation fluid in the container. Where it takes several minutes, a build-up time period from a power-on state or a sleep mode is too long for a fixation device or an image forming apparatus and it may be a considerable disadvantage from the viewpoint of usability and operativity thereof. In order to provide a fixation device or image forming apparatus excellent in operativity thereof, it may necessarily take a time period equal to or less than several seconds to obtain a bubbly fluid containing a bubble with a desired diameter from a liquid. The reason why it takes several minutes to obtain a desired bubble diameter by means of simple agitation is that it is not easy for a bubble to become a fine bubble with a size of 5 μm-50 μm.

Meanwhile, in the case of a large bubble with a size of, generally, about 0.5 mm-about 1 mm, it is generally possible to produce a bubble comparatively easily by means of simple agitation or the like, and it may take a time period equal to or less than several seconds (less than 0.1 second) to create a large bubble. Then, attention has been focused on the point that a bubble with a size larger than such a desired bubble diameter and as being visually observable may be easily created and quickly obtained and a method for quickly creating a fine bubble with a size of about 5 μm-about 50 μm from a large bubble has been actively studied. As a result, it has been found that when a shear is applied to a large bubble to divide the large bubble, a fine bubble with a desired size may be created extremely quickly, compared to a method for creating a fine bubble from a liquid state as described above. An embodiment of the present invention is based on the result described above.

Figure 3A:
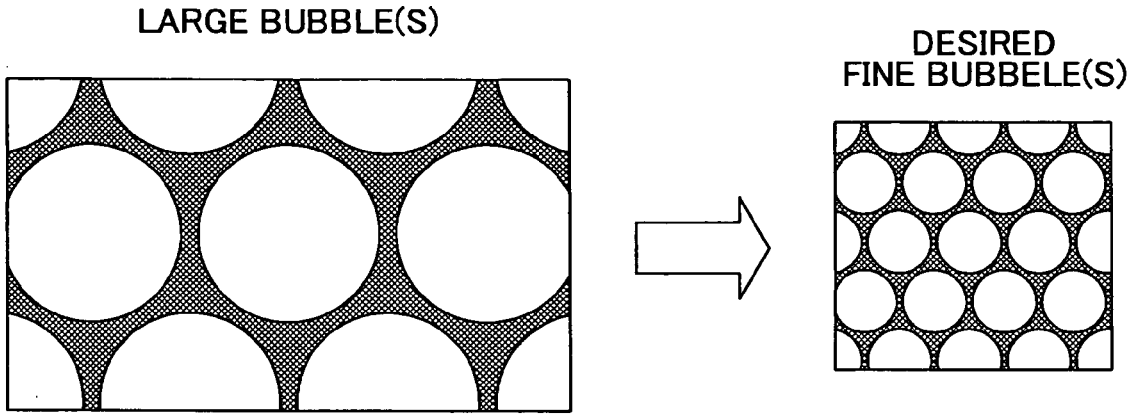
FIGS. 3A and 3B are schematic cross-sectional diagrams showing a situation of a process for creating desired fine bubbles from large bubbles according to the principle of an embodiment of the present invention.
Figure 3B:
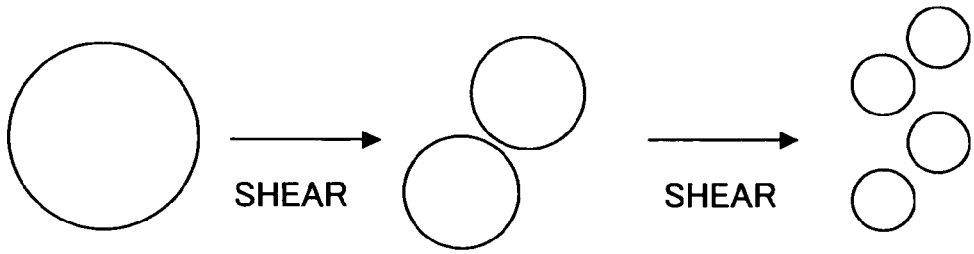

FIGS. 3A and 3B are schematic diagrams showing the concept of a bubbly fixation fluid producing method according to an embodiment of the present invention. As shown in FIG. 3A, a bubble with a desired diameter is created by dividing a large bubble with a size larger than a desired bubble diameter into small bubbles. For the process thereof, as shown in FIG. 3B, when a shear is applied to a large bubble, it is easily divided into two or more small bubbles. When a further shear is applied to the small bubble, each small bubble is easily divided into two or more fine bubbles. As a series of these processes is repeated, a large bubble may be changed to desired fine bubbles during a short time period. Thus, as compared to the case where a bubbly fixation fluid with a bubble size of about 5 μm-about 50 μm is provided from a liquid by means of simple agitation, a similar bubbly fixation fluid may be produced during an extremely short time period.

Additionally, in regard to the bubble diameter larger than a desired bubble diameter (wherein a bubble diameter refers to the diameter of a bubble), it is desirable to be twice to twenty times larger than the desired diameter, when easy and quick production is taken into consideration. When the desired range of a bubble diameter is about 5 μm-about 50 μm, the maximum diameter of a bubble is 50 μm in regard to the desired bubble diameter and it is desirable that a large bubble has a size of about 100 μm-about 1 mm. However, an even larger bubble diameter of about 2 mm-about 3 mm is also available.

However, although a large bubble may be divided into two or more bubbles, it is disadvantageous that when a bubble is divided, the bubble vanishes. That is, a bubble may necessarily be excellent in bubble stability. Therefore, it may be necessary to contain water and a salt of aliphatic acid in a fixation fluid which salt is excellent in bubble creation. Also, it is desirable to contain a bubble increasing agent excellent in bubble stability, such as alkanol amides of coconut oil fatty acid.

Herein, a method having a first process for creating a large bubble in one bubble creating part and a second process for subsequently dividing the bubble into fine bubbles is described as one of the methods for creating a large bubble and subsequently dividing the large bubble into bubbles so as to produce fine bubbles, below.

Figure 4:
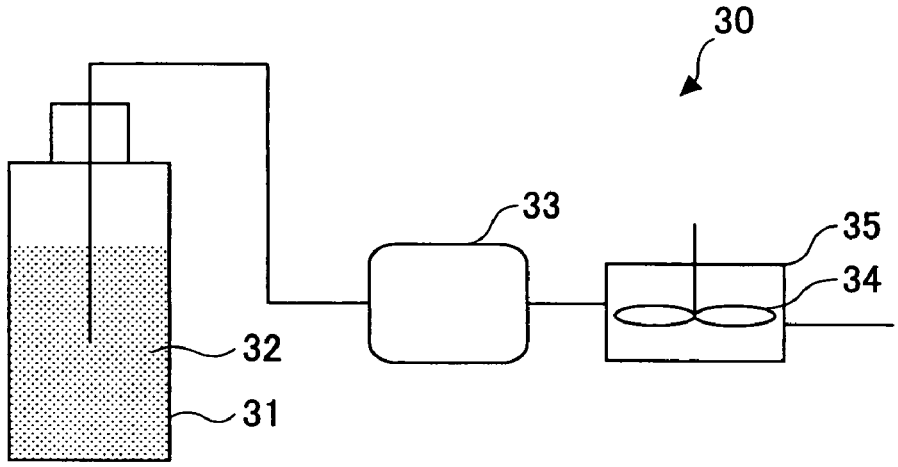
FIG. 4 is a schematic diagram showing the configuration of a bubbly fixation fluid producing device according to a first embodiment of the present invention.

FIG. 4 is a schematic diagram showing the configuration of a bubbly fixation fluid producing part according to a first embodiment of the present invention. Due to a bubbly fixation fluid producing part 30 in the embodiment shown in FIG. 4, a liquid fixation fluid 32 in a fixation fluid container 31 is delivered to an agitation part 35 for agitating a fluid by a wing-type stirrer 34, by using a delivery part such as a delivery pump 33. The number of rotation of the wing-type stirrer 34 is low so as to be about 100 rpm-about 500 rpm and a large bubble is created by means of agitation while a gas is involved. Then, a large bubble may be divided into bubbles by increasing the number of rotation of the wing-type stirrer 34 up to 3,000-5,000 rotations per minute after the large bubble is created, whereby a bubbly fixation fluid containing a bubble having a desired diameter may be produced. Also, there is a method for producing a bubbly fixation fluid containing a bubble with a desired diameter, in which a wing-type stirrer with a shape for creating a large bubble is replaced by another wing-type stirrer with a shape for dividing a large bubble into bubbles. Furthermore, there is also a method for producing a bubbly fixation fluid containing a bubble having a desired diameter, in which a large bubble is created by using a bubbly fixation fluid producing part having a closed double cylinder structure for applying a shear to a fixation fluid described below where the number of rotation of an inner cylinder is set to a predetermined number of rotation, and subsequently increasing the number of rotation so as to apply a larger shear to a large bubble to divide the bubble.

However, since a large bubble creating process and a bubble dividing process are in one part according to the bubbly fixation fluid producing member 30 of the first embodiment, production of a bubbly fixation fluid is in a batch process and a time lag of supplement may occur. Then, as another method for creating a bubble with a desired diameter, a method is desirable such that a part for creating a large bubble is provided separately from a part for dividing the large bubble into bubbles so that a bubbly fixation fluid is sequentially produced and a time lag of supplement is eliminated.

Figure 5:
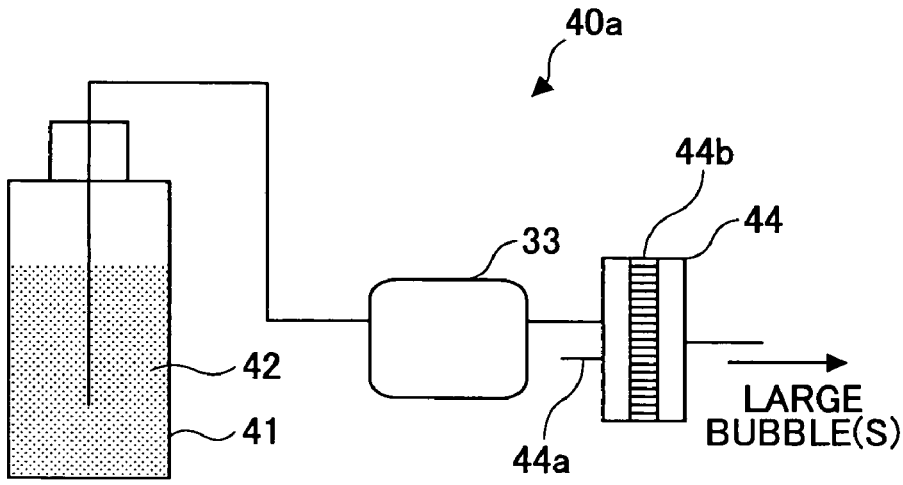
FIG. 5 is a schematic diagram showing the configuration of a large bubble creating part in the bubbly fixation fluid producing device according to the first embodiment of the present invention.

FIG. 5 is a schematic diagram showing the configuration of a large bubble creating part in a bubbly fixation fluid producing part according to the first embodiment of the present invention. Due to a bubble creating part 40*a* shown in FIG. 5, a liquid fixation fluid 42 in a fixation fluid container 41 is supplied to a gas-liquid mixing part 44 by using a fluid transporting part such as a delivery pump 43. The gas-liquid mixing part 44 is provided with an air port 44*a* and a large bubble with a generally uniform diameter may be created by generating a negative pressure at the air port 44*a* with a liquid flow, introducing a gas from the air port 44*a* into the interior of the gas-liquid mixing part 44, mixing a liquid fixation fluid and the gas, and passing it through a micro-porous sheet 44*b*. Additionally, it is desirable that the pore size of the micro-porous sheet 44*b* is about 30 μm-about 100 μm. Also, it is not limited to the micro-porous sheet 44*b* in FIG. 5 but is only necessary to be an open-cell porous member, and it may be a sintered ceramic plate, non-woven cloth or foamed resin sheet having a pore size of about 30 μm-about 100 μm.

Figure 6:
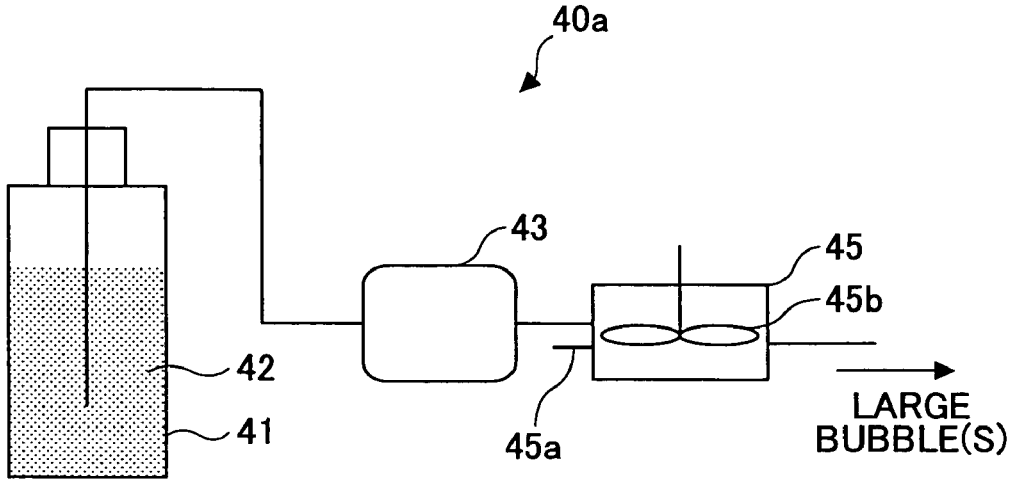
FIG. 6 is a schematic diagram showing the configuration of another large bubble creating part in the bubbly fixation fluid producing device according to the first embodiment of the present invention.

FIG. 6 is a schematic diagram showing the configuration of another large bubble creating part in a bubbly fixation fluid producing part according to the first embodiment of the present invention. In FIG. 6, the same reference numeral as that in FIG. 5 refers to the same component. Due to another large bubble creating part 40*a* shown in FIG. 6, a liquid fixation fluid 42 in a fixation fluid container 41 is supplied to a gas-liquid agitating part 45 by using a fluid transporting part such as a delivery pump 43. Then, a liquid fixation fluid and a gas from an air port 45*a* are stirred by a wing-type stirrer 45*b* in the gas-liquid agitating part 45, so that a large bubble is created while the gas is involved in the liquid fixation fluid.

Figure 7:
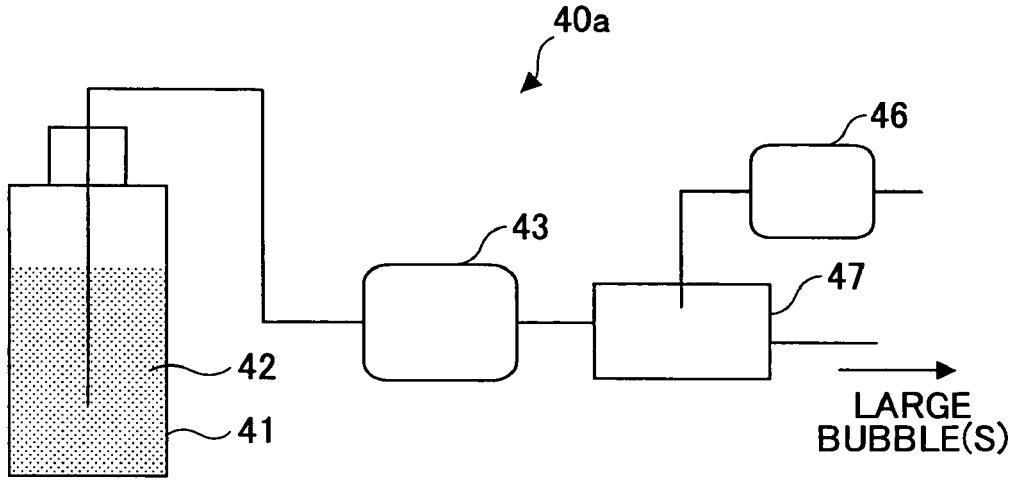
FIG. 7 is a schematic diagram showing the configuration of another large bubble creating part in the bubbly fixation fluid producing device according to the first embodiment of the present invention.

FIG. 7 is a schematic diagram showing the configuration of another large bubble creating part in a bubbly fixation fluid producing part according to the first embodiment of the present invention. In FIG. 7, the same reference numeral as that in FIG. 5 refers to the same component. Due to another large bubble creating part 40*a* shown in FIG. 7, a liquid fixation fluid supplied by a delivery part such as a delivery pump 43 is bubbled by an air supplying pump 46 or the like in an air bubbling part 47 so as to create a large bubble.

Next, a fine bubble creating part for creating a desired fine bubble by dividing a large bubble created by a large bubble creating part as shown in FIGS. 5, 6 and 7 into two or more bubbles is described below. The fine bubble creating part is such that a shear is applied to a large bubble and division of a large bubble into two or more bubbles is facilitated to create a desired fine bubble, as described above.

Figure 8A:
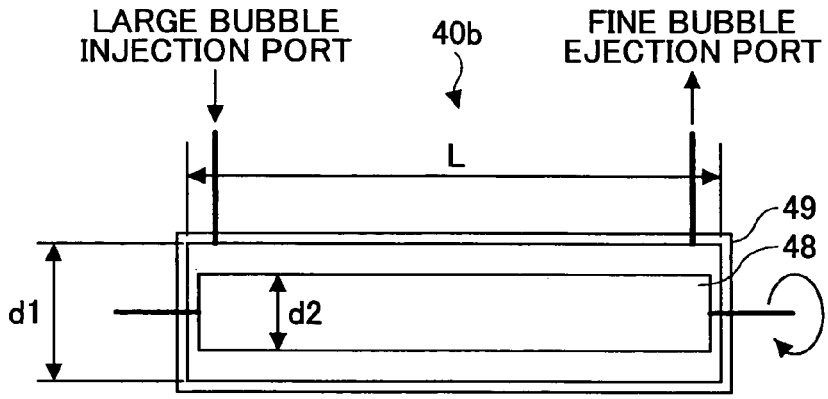
FIGS. 8A, 8B and 8C are schematic diagrams showing the configuration of a fine bubble creating part in the bubbly fixation fluid producing device according to the first embodiment of the present invention.
Figure 8B:
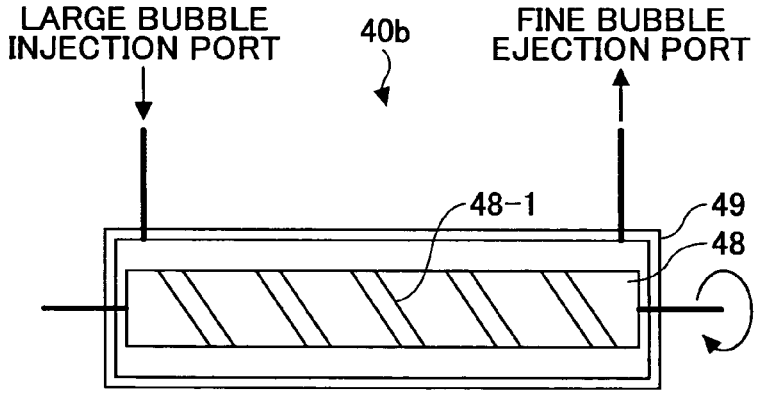
Figure 8C:
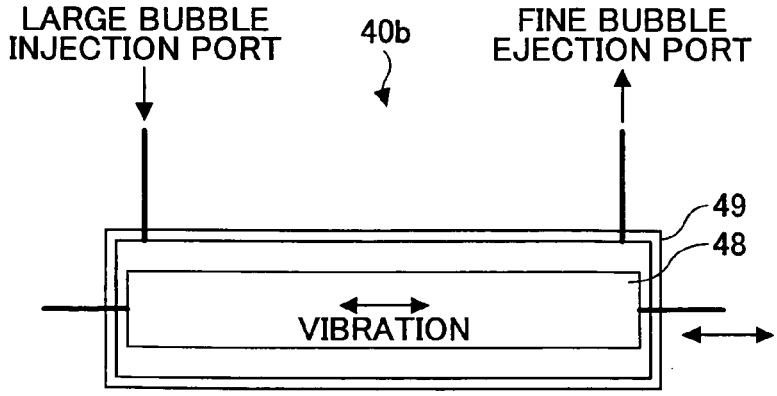

FIGS. 8A, 8B and 8C are schematic diagrams showing the configuration of a fine bubble creating part in a bubbly fixation fluid creating part according to the first embodiment of the present invention. A fine bubble creating part 40*b* shown in FIG. 8A has a closed double cylinder structure. An inner cylinder 48 has a rotatable structure and a fixation fluid containing a large bubble is supplied from a large bubble injection port which is provided on a part of an outer cylinder 49. The fixation fluid containing a large bubble passing through a gap between the rotating inner cylinder 48 and the outer cylinder 49 as a flow channel is subjected to a shear generated by the rotating inner cylinder 48 and the outer cylinder 49. Due to the shear, the fixation fluid containing a large bubble is changed to a fine bubble, and a bubbly fixation fluid containing a fine bubble having a desired diameter may be obtained from a fine bubble ejection port provided on a part of the outer cylinder 49.

Herein, the rate of fluid delivery is determined depending on the number of rotation of the rotating inner cylinder 48 and the length of the inner cylinder 48 in the longitudinal directions thereof. Herein, it has been found that the rate V ($mm^3$/second) of fluid delivery for creating a fine bubble is determined by a formula of $$V=L\times\pi\times(d1^2-d2^2)/4/(1000/R),$$

wherein the inner diameter and cylinder length of the outer cylinder 49 are denoted by d1 (mm) and L (mm), respectively, and the outer diameter and number of rotation of the inner cylinder 48 are d2 (mm) and R (rpm), respectively.

For example, when d1, d2, L, and the number of rotation R are 10 mm, 8 mm, 50 mm, and 1,000 rpm, respectively, the rate of fluid delivery is approximately 1,400 $mm^3$/second (1.4 cc/second). If the amount of a bubbly fixation fluid which is required for conducting fixation on a paper sheet of A4 is 3 cc, it takes only about 2 seconds to produce a required amount, 3 cc, of the bubbly fixation fluid from a liquid fixation fluid, so that it may be possible to produce a bubbly fixation fluid containing a fine bubble having a desired diameter extremely quickly.

Also, a fine bubble creating part 42*b* shown in FIG. 8B has a configuration such that a spiral groove 48*a* is provided on the surface of an inner cylinder 48 so as to improve fluid delivery in a flow channel which is a gap between the rotating inner cylinder 48 and an outer cylinder 49. Additionally, the pitch of the spiral groove 48*a* and the width of the groove are determined as design values depending on the fluid viscosity of a fixation fluid and the steady flow viscosity of a bubbly fixation fluid containing a fine bubble.

Furthermore, a fine bubble creating part 40*b* shown in FIG. 8C is another configuration for applying a shear and has a configuration for vibrating an inner cylinder 48 parallel in the longitudinal directions of the outer cylinder 49. Additionally, it is desirable that the amplitude and frequency of the vibration are generally an amplitude of about 0.5 mm to about 1 mm and a frequency of about 50 Hz to about 100 Hz, respectively.

Figure 9:
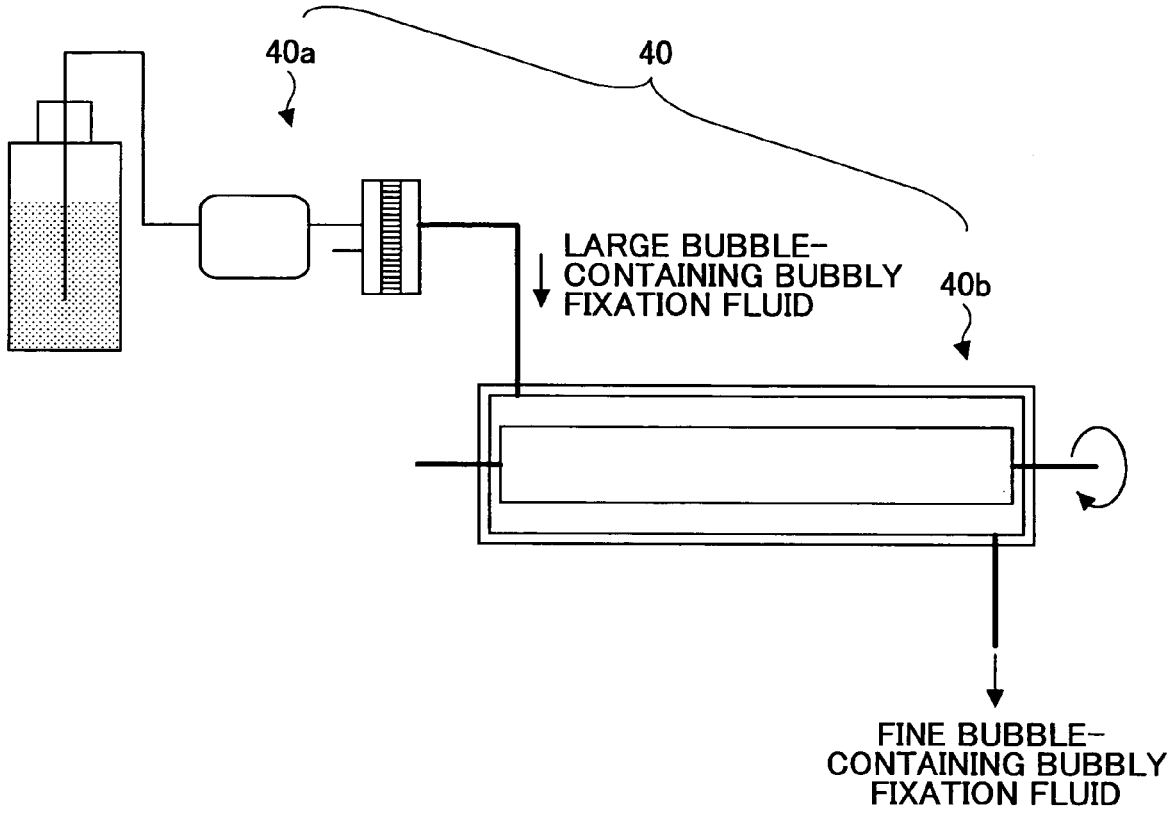
FIG. 9 is a schematic diagram showing the configuration of the bubbly fixation fluid producing device according to the first embodiment of the present invention.

FIG. 9 is a schematic diagram showing the configuration of a bubbly fixation fluid producing part according to the first embodiment of the present invention. As shown in FIG. 9, a bubbly fixation fluid producing part 40 according to the embodiment is a combination of a large bubble creating part 40*a* as shown in each of FIGS. 5, 6 and 7 and a fine bubble creating part 40*b* as shown in each of FIGS. 8A, 8B and BC, and it may be possible to produce a bubbly fixation fluid containing a fine bubble having a diameter of about 5 μm-50 μm from a liquid fixation fluid during an extremely short time period.

Next, a fixation fluid providing part in a fixation device according to an embodiment of the present invention is described below.

Figure 10A:
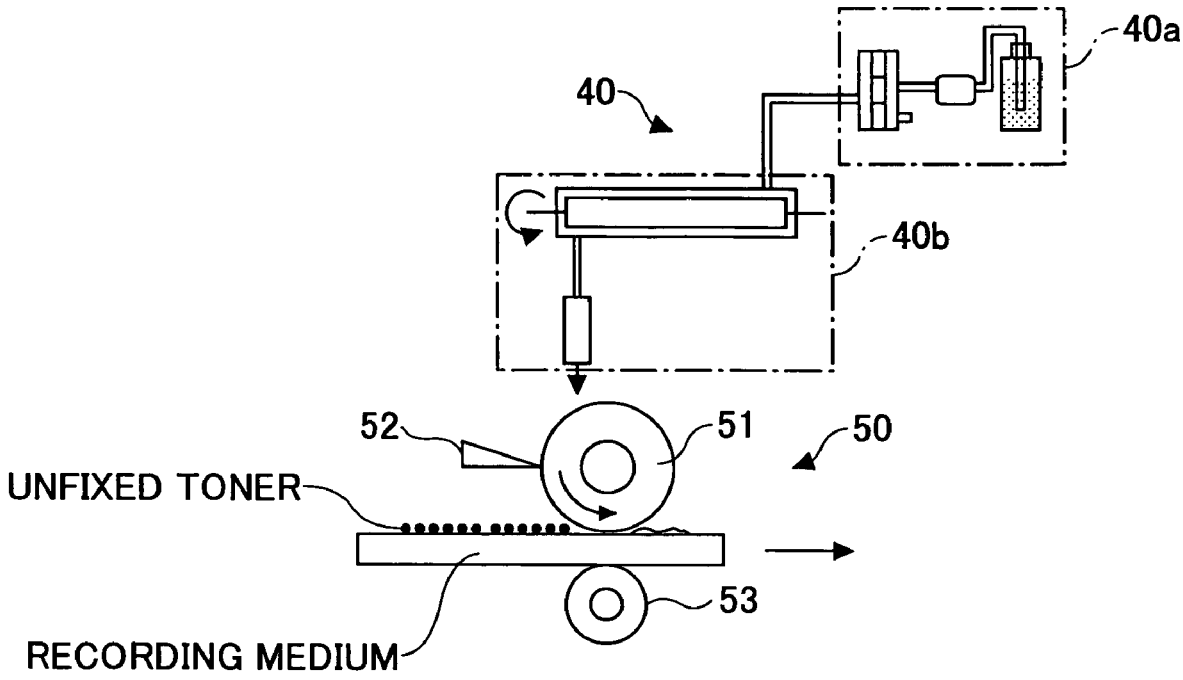
FIGS. 10A and 10B are schematic configuration diagrams showing one example of a fixation fluid providing device in a fixation device according to an embodiment of the present invention.
Figure 10B:
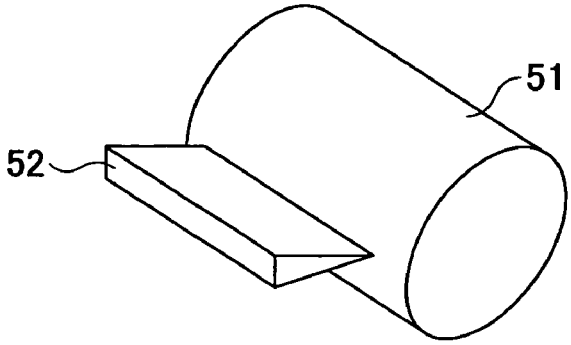

FIGS. 10A and 10B are schematic diagrams showing one example of a fixation fluid providing part in a fixation device according to an embodiment of the present invention. Herein, a resin fine particle according to an embodiment of the present invention is a toner particle. A fixation fluid providing part 50 shown in FIG. 10A is provided with an application roller 51 for providing a bubbly fixation fluid containing a desired fine bubble on a resin fine particle layer (toner particle layer) which fluid is produced by the bubbly fixation fluid producing part 40 as described above, and a pressurizing roller 53 at the opposite position, wherein a fluid film thickness controlling blade 52 is pressed against and contacts an application roller surface so as to control the film thickness of the bubbly fixation fluid containing a desired fine bubble and thus an optimal film thickness control of the bubbly fixation fluid is conducted. As shown in FIG. 10B, a layer of the bubbly fixation fluid is formed on the application roller 51 via the fluid film thickness controlling blade 52 so as to provide an optimized film thickness of the fixation fluid layer which depends on the size and pressure of a gas bubble in the bubbly fixation fluid and the thickness of a unfixed toner layer. No resin fine particle is offset by using a bubbly fixation fluid provided by the fixation fluid providing part 50 shown in FIG. 10A. If the bubbly fixation fluid was thickly provided on a resin fine particle layer or a recording medium, the volume density of the bubbly fixation fluid would be extremely low, and therefore, a slight amount of a liquid containing a softening agent could be provided on the resin fine particle layer by bubble breaking of a contained gas bubble after a predetermined bubbling time period had passed. As described above, the bubbly fixation fluid containing a desired fine particle is produced by a bubbly fixation fluid producing part 40 composed of a large bubble creating part 40*a* for creating a large bubble and a fine bubble creating part 40*b* for creating a fine bubble by dividing the large bubble into bubbles with a shear and dropped from a fluid supplying port to between the fluid film thickness controlling blade 52 and the application roller 51.

Additionally, it is desirable that the volume density of the bubbly fixation fluid is in the range of about 0.01 $g/cm^3$-about 0.1 $g/cm^3$. Furthermore, the fixation fluid is only necessarily bubbly at the time of application on a layer of resin fine particle such as a toner on a recording medium such as a paper sheet and is not required to be in a storage container. Desirable is a configuration such that it is a liquid containing no gas bubble in a storage container and there is provided a device for making it bubbly at the time of supplying the liquid from the container or on the liquid delivery route for providing it to the layer of resin fine particle. This is because a configuration such that it is liquid in a storage container and is made bubbly after the liquid is taken the liquid from the container has a great advantage such that the container may be compact.

In the fixation fluid providing part 50 having such a configuration, a paper sheet is used as a medium and a bubbly fixation fluid is provided on an unfixed toner surface by the application roller 51 while a paper sheet to which the unfixed toner attaches is delivered. The fluid film thickness controlling blade 52 may be either counter-directional or tailing directional. Also, a spacer for controlling a gap between the application roller 51 and the fluid film thickness controlling blade 52 may be provided.

Also, a delivery pump is used as a device for delivering a liquid fixation fluid from a fixation fluid enclosing container to a mechanism for bubbling it. For the delivery pump, a gear pump, a bellows pump, and the like are provided and a tube pump is desirable. When there is a vibration mechanism or rotation mechanism in the fixation fluid like a gear pump, the fluid may be bubbled in a pump, so that the fluid may be provided with a compressive property so as to degrade delivery performance. Also, a component of the mechanism or the like may contaminate a fixation fluid or, on the contrary, a component of the mechanism may be contaminated. On the other hand, since a tube pump has a mechanism for squeezing a liquid in a tube while the tube is deformed, the tube is only a member contacting a fixation fluid and a member having a liquid resistance to the fixation fluid is used, thereby providing no liquid contamination or no degradation of a component of a pump system. Also, since only the tube is deformed, the fluid is not bubbled and therefore the degradation of delivery performance may be prevented.

Figure 11A:
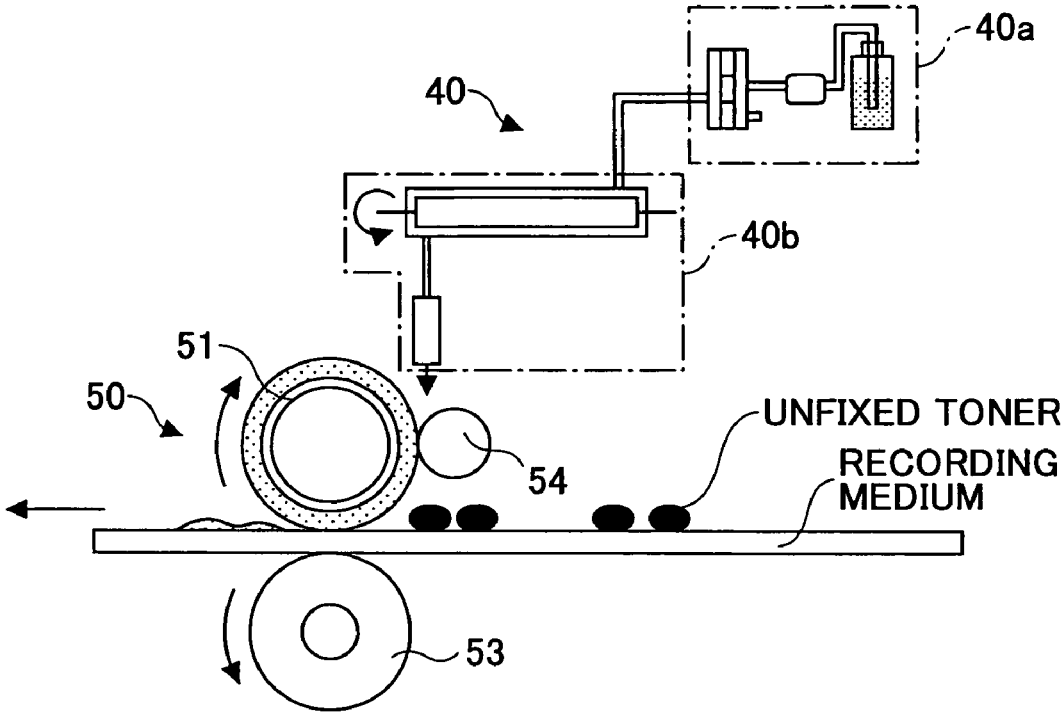
FIGS. 11A and 11B are schematic configuration diagrams showing another example of a fixation fluid-providing device in a fixation device according to an embodiment of the present invention.
Figure 11B:
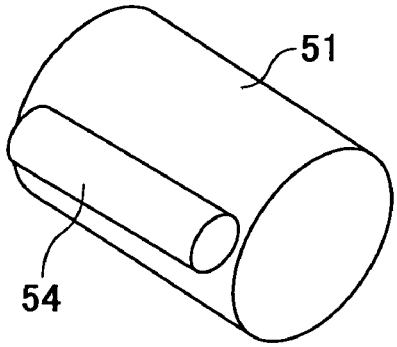

Also, as shown in FIGS. 11A and 11B, while the thickness of a bubbly fixation fluid on an application roller is controlled by a fluid film thickness controlling wire bar 54, the bubbly fixation fluid is produced by a bubbly fixation fluid producing part 40 composed of a large bubble creating part 40*a* for creating a large bubble and a fine bubble creating part 40*b* for creating a fine bubble by dividing the large bubble into bubbles with a shear, as described above, and is dropped from a fluid supplying port to between the fluid film thickness controlling wire bar 54 and the application roller 51, and the wire bar 54 is used as a film thickness controlling part so as to improve the uniformity of a bubbly fixation fluid film in the axial directions of an application roller surface, compared to the fluid film thickness controlling blade.

Figure 12:
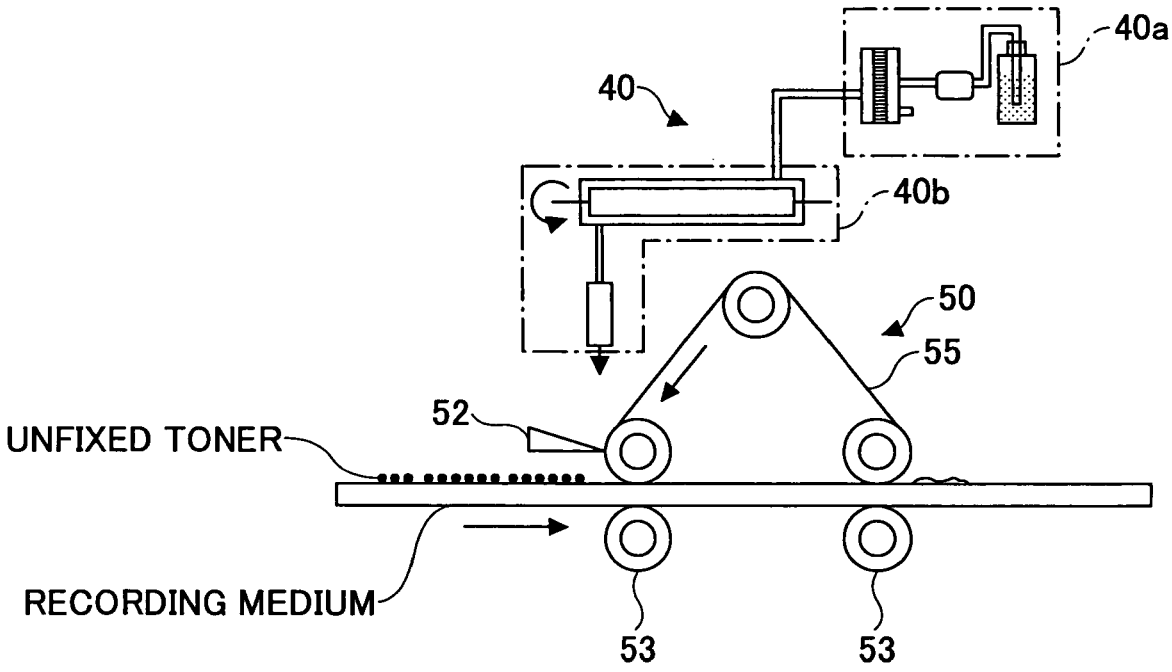
FIG. 12 is a schematic configuration diagram showing another example of a fixation fluid-providing device in a fixation device according to an embodiment of the present invention.

Furthermore, as shown in FIG. 12, there is also provided a method of application to an unfixed toner on a recording medium by using an application belt instead of the application roller shown in FIG. 11. As described above, a bubbly fixation fluid containing a bubble having a desired diameter is produced by the bubbly fixation fluid producing part 40 composed of the large bubble creating part 40*a* for creating a large bubble and the fine bubble creating part 40*b* for creating a fine bubble by dividing the large bubble into bubbles with a shear, and supplied from a fluid supplying port. Then, the gap between the fluid film thickness controlling blade 52 and the application belt 55 is adjusted to control the film thickness of a bubbly fixation fluid on the application belt 55, and thus a control of the optimum film thickness of the bubbly fixation fluid is conducted. Additionally, for such an application belt, for example, a member in which a substrate such as a seamless nickel belt and a seamless PET file is coated with a releasing fluorine-containing resin such as PFA may be used.

Next, the fluid formulation of a fixation fluid is described below. As described above, a bubbly fixation fluid is configured to contain a gas bubble in a liquid containing a softening agent. Water is used as a base material. The liquid containing a softening agent desirably has a bubbling agent or a bubble increasing agent since it stably contains a gas bubble and becomes bubbly for providing a gas bubble layer composed of gas bubbles having as uniform a size as possible. Also, since a gas bubble is stably dispersed in a liquid when the viscosity is comparatively high, it is desirable to contain a thickening agent.

Furthermore, a salt of aliphatic acid is desirable for the bubbling agent. Since a salt of aliphatic acid has a surface activity, the surface tension of a fixation fluid containing water is reduced to facilitate bubbling of the fixation fluid, and since a salt of aliphatic acid has a layered or lamellar structure on a bubble surface, the bubble wall (plateau boundary) thereof is more robust than that of another surfactant, and accordingly, the bubbling stability may be extremely high. Moreover, it is desirable that the fixation fluid contains water in order that the bubbling property of a salt of aliphatic acid is effective. For the aliphatic acid, a saturated aliphatic acid, which is resistive to oxidation, is desirable from the viewpoint of the long-term stability in the atmosphere. However, the solubility or dispersibility of a salt of aliphatic acid in water is facilitated by containing a slight content of a salt of unsaturated aliphatic acid in a fixation fluid containing a salt of saturated aliphatic acid, and it may be possible to have an excellent bubbling property at a low temperature of 5° C.-15° C. Also, the fixation may be stabilized in a wide range of environmental temperature and separation of a salt of aliphatic acid from a fixation fluid may be prevented during leaving of the fixation fluid for a long period.

Furthermore, saturated aliphatic acids with a carbon number of 12, 14, 16 or 18, more specifically, lauric acid, myristic acid, palmitic acid, and stearic acid, are suitable for an aliphatic acid used for the salt of saturated aliphatic acid. Salt of saturated aliphatic acid with a carbon number equal to or less than 11 has a comparatively strong odor, and accordingly, are not suitable for an image forming instrument using the fixation fluid and being used in an office or home. Also, salts of saturated aliphatic acid with carbon number equal to or more than 19 has a comparatively low solubility in water so as to degrade the leaving stability of a fixation fluid significantly. A salt(s) of saturated aliphatic acid which is/are derived from these saturated aliphatic acids is used singularly or mixed for a bubbling agent.

Also, a salt of unsaturated aliphatic acid may be used and unsaturated aliphatic acids with a carbon number of 18 and double bond number of one through three are desirable. Specifically, oleic acid, linoleic acid, and linolenic acid are suitable. Since the number of double bonds is 4 or more, the reactivity is so high that the leaving stability of a fixation fluid is degraded. A salt(s) of unsaturated aliphatic acid, which is/are derived from these unsaturated aliphatic acids, is/are used singularly or mixed for a bubbling agent. Also, the salt of saturated aliphatic acid and the salt of unsaturated aliphatic acid may be mixed and used as a bubbling agent.

Furthermore, when the salt of saturated aliphatic acid or the salt of unsaturated aliphatic acid is used as a bubbling agent for the fixation fluid, a sodium salt, a potassium salt, or an amine salt is desirable. After a fixation device is powered-on, it is an important factor in terms of the commercial value of the fixation device to provide a state capable of fixation quickly. It may be essential for a fixation fluid to be suitably bubbly in order to provide a state capable of fixation in a fixation device and a state capable of fixation may be provided by quick bubbling due to the above salt of aliphatic acid for a short time period after power-on. Particularly, as an amine salt is made, a fixation fluid may be bubbled for the shortest time period when a shear is applied, and it may be possible to produce a bubbly fixation fluid easily. Then, a state capable of fixation may be provided for the shortest time period after the power-on of a fixation device.

Also, it is desirable that the thickness of a bubbly fixation fluid layer in a bubbly fixation fluid providing part is larger than the thickness of a resin fine particle layer for prevention of offset. Furthermore, it is desirably larger than resin fine particles in order that a gas bubble easily attaches to the resin fine particle. When the resin fine particle is a toner particle, the size of a toner particle is about 4 μm-about 10 μm and the thickness of an unfixed toner layer on a paper medium is about 10 μm-about 30 μm in a dry electrophotographic process. Accordingly, the thickness of a bubbly fixation fluid in a bubbly fixation fluid providing part is desirably equal to or more than about 10 μm-about 30 μm and the bubble diameter is desirably about 5 μm-about 50 μm.

Furthermore, a softening agent for softening a resin fine particle by dissolving or swelling it includes an aliphatic ester. The aliphatic ester is excellent in a dissolving property or swelling property for dissolving or swelling at least one portion of a resin contained in a toner or the like.

Also, it is preferable that the acute oral toxicity LD50 of a softening agent is greater than 3 g/kg, more preferably, is 5 g/kg, from the viewpoint of the safety thereof for a human body. The safety of aliphatic esters for a human body is so high that they are frequently used as cosmetic materials.

Furthermore, since toner fixation on a recording medium is conducted in an instrument which is frequently used in a closed environment and a softening agent remains in a toner after fixation of the toner on a recording medium, it is preferable that fixation of toner on a recording medium involves no generation of a volatile organic compound (VOC) or unpleasant odor. That is, it is preferable that a softening agent includes no volatile organic compound (VOC) or a material causing unpleasant odor. An aliphatic ester has a high boiling point and a low volatility and no irritating odor, compared with commonly used organic solvents (toluene, xylene, methyl ethyl ketone, ethyl acetate, and the like).

Additionally, for a practical measure for odor measurement which may measure odor with a high precision in an office environment or the like, an odor intensity index (10×log (dilution strength of a substance at which the odor of the substance is not sensed)) based on a triangle odor bag method that is a sensory measurement may be used as an index of odor intensity. Also, it is preferable that the odor intensity index of an aliphatic ester contained in a softening agent is equal to or less than 10. In this case, unpleasant odor is not sensed in a usual office environment. Furthermore, it is preferable that another fluid material contained in the fixation fluid, as well as the softening agent, also has no unpleasant odor or no irritating odor.

In a fixation fluid according to an embodiment of the present invention, the aliphatic ester preferably includes a saturated aliphatic ester. When the aliphatic ester includes a saturated aliphatic ester, the storage stability of a softening agent (the resistance thereof to oxidation, hydrolysis or the like) may be improved. Also, the safety of saturated aliphatic esters for a human body is high and many of saturated aliphatic esters may dissolve or swell a resin contained in a toner within one second. Furthermore, saturated aliphatic esters may reduce the stickiness of a toner provided on a recording medium. It is considered that this is because a saturated aliphatic ester forms an oily membrane on the surface of a dissolved or swelled toner.

Therefore, in a fixation fluid according to an embodiment of the present invention, the saturated aliphatic ester preferably includes a compound represented by a general formula of R1COOR2, wherein R1 is an alkyl group whose carbon number is equal to or more than 11 and equal to or less than 14 and R2 is a linear or branched alkyl group whose carbon number is equal to or more than 1 and equal to or less than 6. When each of the carbon numbers of R1 and R2 is less than the desired range, odor may be generated and when it is more than the desired range, the resin softening capability may be degraded.

That is, when the saturated aliphatic ester includes a compound represented by a general formula of R1COOR2, wherein R1 is an alkyl group whose carbon number is equal to or more than 11 and equal to or less than 14 and R2 is a linear or branched alkyl group whose carbon number is equal to or more than 1 and equal to or less than 6, the dissolving property or swelling property thereof for a resin contained in a toner may be improved. Also, the odor intensity index of the compound described above is equal to or less than 10 and the compound described above has no unpleasant odor and no irritating odor.

For an aliphatic monocarboxylate ester which is the compound described above, there may be provided, for example, ethyl laurate, hexyl laurate, ethyl tridecylate, isopropyl tridecylate, ethyl myristate, isopropyl myristate, and the like.

Many of these aliphatic monocarboxylate esters which are the compounds described above are soluble in an oily solvent but are insoluble in water. Therefore, in regard to many of the aliphatic monocarboxylate esters which are the compounds described above, a fixation fluid with a configuration of dissolution or micro-emulsion is provided by containing a glycol as a dissolution auxiliary in an aqueous solvent.

Also, in a fixation fluid according to an embodiment of the present invention, the aliphatic ester preferably includes an aliphatic dicarboxylate ester. When the aliphatic ester includes an aliphatic dicarboxylate ester, a resin contained in a toner may be dissolved or swelled for a shorter time period. For example, it is desirable that a time period for which a fixation fluid is provided onto an unfixed toner on a recording medium and the toner fixes on the recording medium is within 1 second in high speed character printing of about 60 ppm. When the aliphatic ester includes an aliphatic dicarboxylate ester, a time period required for providing a fixation fluid to an unfixed toner or the like on a recording medium and fixing the toner on the recording medium may be within 0.1 second. Furthermore, since a resin contained in a toner may be dissolved or swelled by addition of a smaller amount of a softening agent, the content of a softening agent contained in a fixation fluid may be reduced.

Therefore, in a fixation fluid according to an embodiment of the present invention, the aliphatic dicarboxylate ester preferably includes a compound represented by a general formula of $R3(COOR4)_2$, wherein R3 is an alkylene group whose carbon number is equal to or more than 3 and equal to or less than 8 and R4 is a linear or branched alkyl group whose carbon number is equal to or more than 3 and equal to or less than 5. When each of the carbon numbers of R3 and R4 is less than the desired range, odor may be generated and when it is more than the desired range, the resin softening capability may be degraded.

That is, when the aliphatic dicarboxylate ester includes a compound represented by a general formula of $R3(COOR4)_2$, wherein R3 is an alkylene group whose carbon number is equal to or more than 3 and equal to or less than 8 and R4 is a linear or branched alkyl group whose carbon number is equal to or more than 3 and equal to or less than 5, the dissolving property or swelling property thereof for a resin contained in a toner may be improved. Also, the odor intensity index of the compound described above is equal to or less than 10 and the compound described above has no unpleasant odor and no irritating odor.

For an aliphatic dicarboxylate ester which is the compound described above, there may be provided, for example, 2-ethylhexyl succinate, dibutyl adipate, diisobutyl adipate, diisopropyl adipate, diisodecyl adipate, diethyl sebacate, dibutyl sebacate, and the like. Many of these aliphatic dicarboxylate esters which are the compounds described above are soluble in an oily solvent but are insoluble in water. Therefore, a fixation fluid with a configuration of dissolution or micro-emulsion is provided by containing a glycol as a dissolution auxiliary in an aqueous solvent.

Furthermore, in a fixation fluid according to an embodiment of the present invention, the aliphatic ester preferably includes a dialkoxyalkyl aliphatic dicarboxylate. When the aliphatic ester includes a dialkoxyalkyl aliphatic dicarboxylate, the fixation property of a toner on a recording medium may be improved.

In a fixation fluid according to an embodiment of the present invention, the dialkoxyalkyl aliphatic dicarboxylate preferably includes a compound represented by a general formula of $R5(COOR6—O—R7)_2$, wherein R5 is an alkylene group whose carbon number is equal to or more than 2 and equal to or less than 8, R6 is an alkylene group whose carbon number is equal to or more than 2 and equal to or less than 4, and R7 is an alkyl group whose carbon number is equal to or more than 1 and equal to or less than 4. When each of the carbon numbers of R5, R6 and R7 is less than the desired range, odor may be generated and when it is more than the desired range, the resin softening capability may be degraded.

That is, when the dialkoxyalkyl aliphatic dicarboxylate includes a compound represented by a general formula of $R5(COOR6—O—R7)_2$, wherein R5 is an alkylene group whose carbon number is equal to or more than 2 and equal to or less than 8, R6 is an alkylene group whose carbon number is equal to or more than 2 and equal to or less than 4, and R7 is an alkyl group whose carbon number is equal to or more than 1 and equal to or less than 4, the dissolving property or swelling property thereof for a resin contained in a toner may be improved. Also, the odor intensity index of the compound described above is equal to or less than 10 and the compound described above has no unpleasant odor and no irritating odor.

Also, for a dialkoxyalkyl aliphatic dicarboxylate which is the compound described above, there may be provided, for example, diethoxyethyl succinate, dibutoxyethyl succinate, diethoxyethyl adipate, dibutoxyethyl adipate, diethoxyethyl sebacate, and the like. Any of these dialkoxyalkyl aliphatic dicarboxylates may be in a fixation fluid with a configuration of dissolution or micro-emulsion which is provided by containing a glycol as a dissolution auxiliary in an aqueous solvent.

Additionally, the fine particle containing a resin which is an object to be fixed is not limited to a toner particle and may be any of particles containing a resin. For example, it may be a resin fine particle containing an electrically conductive material. Also, the recording medium is not limited to a recording paper sheet and may be, for example, any of metallic, resinous, and ceramic ones. However, the recording medium desirably has a permeability of a fixation fluid, and when a substrate plate of a medium has no fluid permeability, a medium which has a fluid permeating layer on the substrate plate is desirable. Also, the form of a recording medium is not limited to a sheet shape and may be a solid object having a planar or curved surface. For example, an embodiment of the present invention is also applicable to an application such that transparent resin fine particles are uniformly fixed on a medium like a paper sheet so as to protect a paper surface (so-called, a varnish coat).

Among the fine particles containing a resin, toner particles used in an electrophotographic process provide the most effective fixation in combination with a fixation fluid according to an embodiment of the present invention. A toner includes a coloring agent, a charge controlling agent, and a resin such as a binder resin and a releasing agent. A resin included in a toner is not particularly limited. For a preferable binder resin, polystyrene resins, styrene-acryl copolymer resins, polyester resins, and the like are provided, and for a releasing agent, for example, wax components such as carnauba wax and polyethylenes and the like are provided. A toner may contain a publicly known coloring agent, charge controlling agent, flowability providing agent, external additive, or the like, as well as a binder resin. Also, it is preferable that a toner is water-repellency-treated by retaining a hydrophobic fine particle such as a hydrophobic silica or hydrophobic titanium oxide having a methyl group on the surface of a toner particle. Among the media, a recording medium is not particularly limited, and for example, paper ones, cloth ones, plastic films such as an OHP sheet having a liquid permeating layer, and the like are provided. The term "oily" in an embodiment of the present invention means a property such that solubility in water at room temperature (20° C.) is equal to or less than 0.1% by weight.

Furthermore, it is desirable that a bubbly fixation fluid preferably has a sufficient affinity with a water-repellency-treated toner particle. Herein, the term "affinity" means the degree of the extension-wetting of a liquid on the surface of a solid when the liquid contacts the solid. That is, it is preferable that a bubbly fixation fluid exhibits a sufficient wetting property to a water-repellency-treated toner. The toner surface that is water-repellency-treated with hydrophobic fine particles such as hydrophobic silica particles and hydrophobic titanium oxide particles is covered with methyl groups present on the hydrophobic silica particles or the hydrophobic titanium oxide particles, and has a surface energy of about 20 mN/m. In fact, since the entire of the water-repellency-treated toner surface is not completely covered with hydrophobic fine particles, it is guessed that the surface energy of the water-repellency-treated toner is about 20 mN/m-about 30 mN/m. Therefore, it is preferable that the surface tension of a bubbly fixation fluid is 20 mN/m-30 mN/m in order to have affinity (or have a sufficient wetting property) with a water-repellent toner.

Also, when an aqueous solvent is used, it is preferable that a surfactant is added such that the surface tension is 20 mN/m-30 mN/m. Also, in the case of an aqueous solvent, it is desirable to contain a monohydric or polyhydric alcohol. These materials have an advantage such that the stability of a gas bubble in a bubbly fixation fluid is improved whereby bubble breaking is hardly caused. For example, monohydric alcohols such as cetanol and polyhydric alcohols such as glycerin, propylene glycol, and 1,3-butylene glycol are desirable. Also, containment of the monohydric or polyhydric alcohol provides an effect of prevention of curling of a recording medium such as paper sheets.

Also, it is desirable to form an O/W emulsion or W/O emulsion by containing an oily component in a fixation fluid in order to improve the permeability thereof or prevent curling of a medium such as paper sheets, and in this case, for a specific dispersing agent, desirable are sorbitan aliphatic esters such as sorbitan monooleate, sorbitan monostearate, and sorbitan sesquiolate and sucrose esters such as sucrose laurates and sucrose stearates.

Herein, for a method for dissolving or micro-emulsion-dispersing a softening agent in a fixation fluid, for example, a mechanical agitation device based on a rotational wing such as a homomixer and a homogenizer and a vibrating device such as an ultrasonic homogenizer are provided. In any of the cases, a softening agent is dissolved or micro-emulsion-dispersed by applying a strong shear stress to a fixation fluid.

Also, a toner fixation device may have a pair of smoothing rollers (hard rollers) for pressurizing a toner dissolved or swelled by an agent for dissolving or swelling at least one portion of a resin contained in the toner (a softening agent) after a fixation fluid according to an embodiment of the present invention is supplied onto the toner. The dissolved or swelled toner is pressurized by the pair of smoothing rollers (hard rollers) so as to smooth the surface of a dissolved or swelled toner layer, so that the toner may be provided with glossiness. Furthermore, the fixation property of a dissolved or swelled toner on a recording medium may be improved by pushing the toner into the recording medium.

In an image forming apparatus according to another embodiment of the present invention, an image of resin containing particles which contain a resin is formed on a recording medium by using an image forming method as described above. Therefore, due to an image forming apparatus according to the embodiment of the present invention, each of an image forming method and image forming apparatus which are capable of fixing a toner on a recording medium more efficiently may be provided as described above.

Figure 13A:
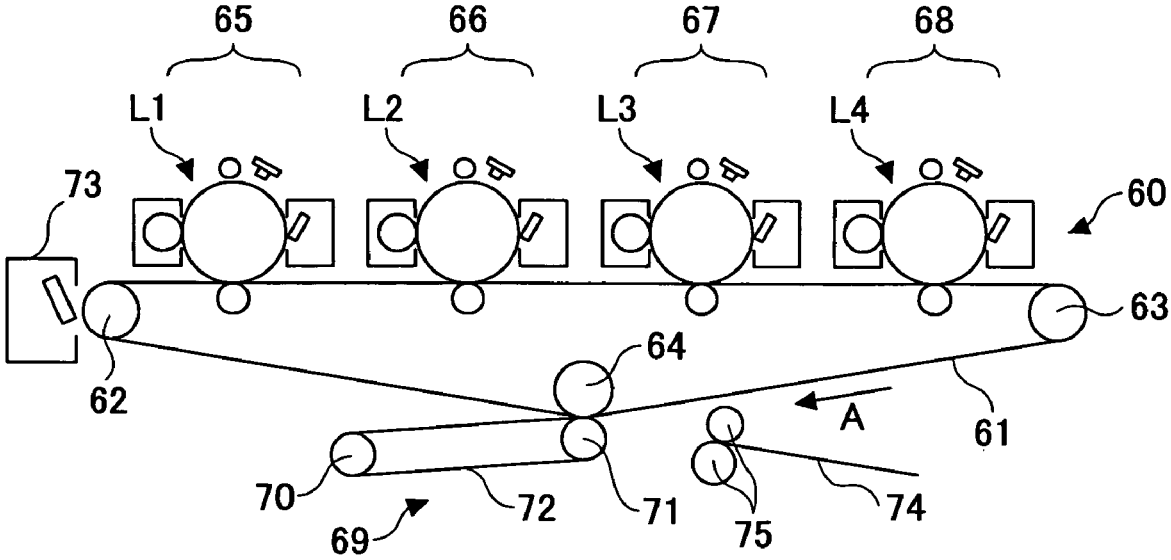
FIGS. 13A and 13B are schematic diagrams showing the configuration of an image forming apparatus according to another embodiment of the present invention.
Figure 13B:
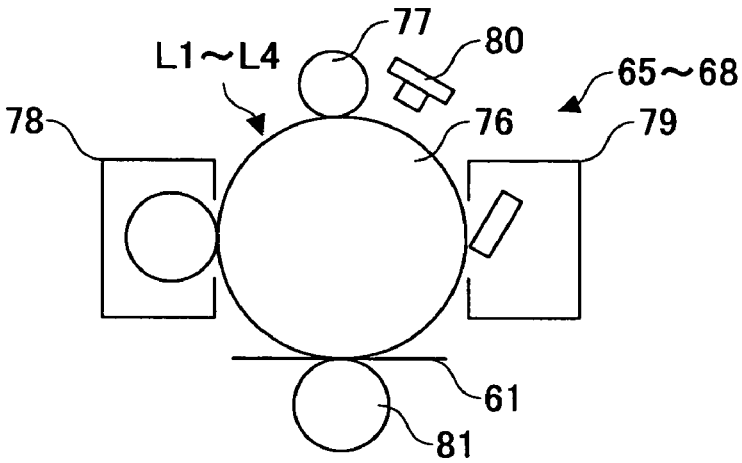
Figure 14A:
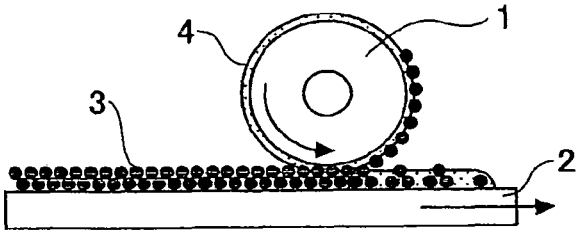
FIG.14A RELATED ART
FIGS. 14A and 14B are schematic cross-sectional diagrams showing the configuration of a conventional fixation device.
Figure 14B:
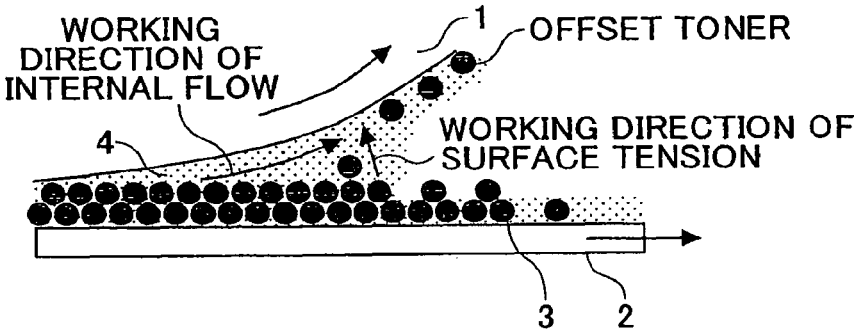
FIG.14B RELATED ART
Figure 15:
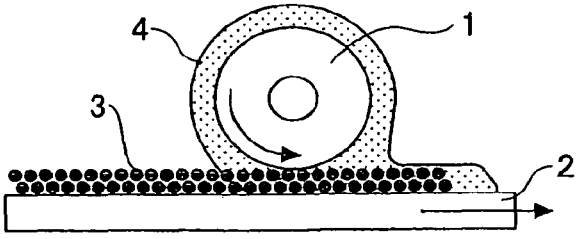
FIG.15 RELATED ART
FIG. 15 is a schematic cross-sectional diagram showing the configuration of a conventional fixation device.

FIGS. 13A and 13B are schematic diagrams showing the configuration of an image forming apparatus according to another embodiment of the present inventions. The image forming apparatus shown in FIGS. 13A and 13B may be a copying machine or a printer. FIG. 13A is a schematic diagram of the entire of a tandem-type color-electrophotographic image forming apparatus and FIG. 13B is a diagram showing the configuration of one image forming unit of the image forming apparatus shown in FIG. 13A.

An image forming apparatus 60 shown in FIGS. 13A and 13B has an intermediate transfer belt 61 as a toner image carrier. The intermediate transfer belt 61 is tensioned and extends on three supporting rollers 62, 63 and 64, and rotates to the direction of arrow A in FIG. 13A. Image forming units 65, 66, 67 and 68 for black, yellow, magenta and cyan, respectively, are arranged for the intermediate transfer belt 61. Above these image forming units, light-exposure devices are arranged which are not shown in FIGS. 13A and 13B. For example, when the image forming apparatus is a copying machine, image information for an original copy is read by a scanner and lights L1, L2, L3 and L4 are emitted from the light-exposure devices, respectively, in order to write an electrostatic latent image on each photoconductor drum in accordance with such image information. A secondary transfer device 69 is provided at a location at which it opposes the supporting roller 64 for the intermediate transfer belt 61 via the intermediate transfer belt 61. The secondary transfer device 69 is composed of a secondary transfer belt 72 which is tensioned and extends on two supporting rollers 70 and 71. Additionally, a transfer roller other than the transfer belt may be used for the secondary transfer device 69. Also, a belt cleaning device 73 is arranged at a location at which it opposes the supporting roller 62 for the intermediate transfer belt 61 via the intermediate transfer belt 61. The belt cleaning device 73 is arranged to eliminate a toner remaining on the intermediate transfer belt 61.

A recording paper sheet 74 as a recording medium is guided to a secondary transfer part by a pair of paper sheet feeding rollers 75, and a toner image is transferred by pushing the secondary transfer belt 72 onto the intermediate transfer belt 61 when the toner image is transferred on the recording paper sheet 74. The recording paper sheet 74 on which the toner image is transferred is conveyed by the secondary transfer belt 72 and the unfixed toner image transferred on the recording paper sheet 74 is fixed by a fixation device according to an embodiment of the present invention, which controls the thickness of a bubbly fixation fluid layer based on image information from an light exposure device which is not shown in FIGS. 13A and 13B. That is, a bubbly fixation fluid according to an embodiment of the present invention which is supplied from a toner fixing device in which the layer thickness of a bubbly fixation fluid layer has been controlled based on image information, for example, a color image or a black solid image, from the light exposure devices which are not shown in FIGS. 13A and 13B, is provided to the unfixed toner image transferred on the recording paper sheet 74, and the unfixed toner image is fixed on the recording paper sheet 74 by an agent for dissolving or swelling at least one portion of a resin contained in the toner (a softening agent) which is contained in the bubbly fixation fluid.

Next, the image forming unit is described below. As shown in FIG. 13B, a charging device 77, a developing device 78, a cleaning device 79 and a charge eliminating device 80 are arranged around the photoconductor drum 76 in each of the image forming units 65, 66, 67 and 68. Also, a primary transfer device 81 is provided at a location at which it opposes the photoconductor drum 76 via the intermediate transfer belt 61. Also, the charging device 77 is a contact-charging-type charging device which uses a charging roller. The charging device 77 uniformly charges the surface of the photoconductor drum 76 by contacting the charging roller with the photoconductor drum 76 and applying a voltage to the photoconductor drum 76. For the charging device 77, a non-contact-charging-type charging device which uses a non-contact scorotron or the like may also be used. Also, the developing device 78 makes a toner in a developer adhere to an electrostatic latent image on the photoconductor drum 76 so that the electrostatic latent image is visualized. Herein, each toner corresponding to each color is composed of a resin material colored with each color and such a resin material may be dissolved or swelled by the fixation fluid according to an embodiment of the present invention. Additionally, the developing device 78 has an agitation part and developing part which are not shown in FIGS. 13A and 13B and a developer which has not been used for development returns to the agitation part and is reused. The concentration of the toner in the agitation part is detected by a toner concentration sensor, which part is controlled such that the concentration of the toner is constant. Furthermore, the primary transfer device 81 transfers the toner visualized on the photoconductor drum 76 to the intermediate transfer belt 61. Herein, for the primary transfer device 81, a transfer roller is used and the transfer roller is pushed onto the photoconductor drum 76 via the intermediate transfer belt 61. For the primary transfer device 81, an electrically conductive brush, a non-contact corona charger, or the like may also be used. Also, the cleaning device 79 eliminates an unwanted toner on the photoconductor drum 76. For the cleaning device 79, a blade with an end pushed onto the photoconductor drum 76 may be used. Herein, the toner recovered by the cleaning device 79 is recovered into and reused in the developing device 78 by a recovering screw and toner recycle device which are not shown in FIGS. 13A and 13B. Furthermore, the charge eliminating device 80 is composed of a lamp and initializes the surface electric potential of the photoconductor drum 76 by light irradiation.

Next, specific examples of a fixation fluid and fixation according to an embodiment of the present invention are described below.

In the following specific examples according to an embodiment of the present invention, toners were used as resin-containing fine particles and production was conducted by one example of a production method as described below.

SPECIFIC EXAMPLE 1

<Formulation of a Fixation Fluid>

—Liquid Containing a Softening Agent—

Dilution solvent: Ion-exchanged water, 65 wt %

Softening agent: diethoxyethyl succinate (Croda Incorporated, Croda DES), 10 wt %

Thickening agent: propylene glycol, 10 wt %

Bubble increasing agent: coconut oil fatty acid diethanolamide (COCAMIDE DEA), 2 wt %

Bubbling agents:

potassium palmitate, 5 wt % potassium myristate, 3 wt % potassium stearate, 2 wt %

Dispersing agents:

POE (20) lauryl sorbitan (Kao Corporation, Leodol TW-S120V), 2 wt %

Polyethylene glycol monostearate (Kao Corporation, EMANON 3199), 1 wt %

Additionally, the dispersing agents were used to increase the solubility of the softening agent in the dilution solvent. First, at the component ratios described above, mixing and agitation were conducted except the softening agent at a liquid temperature of 120° C. so as to manufacture a solution. Then, the softening agent was mixed and a fixation liquid (original liquid before bubbling) in which the softening agent was dissolved was manufactured by using an ultrasonic homogenizer.

<Application Device>

-Large Bubble Creating Part-

It was manufactured according to FIG. 5.

Container for the liquid fixation fluid described above: Bottle made of a PET resin Fluid delivery pump: Tube pump (Tube inner diameter, 2 mm: Tube material, a silicone rubber)

Delivery flow channel: Silicone rubber tube with an inner diameter of 2 mm

Micro-porous sheet for creating large bubbles: # 400 stainless mesh sheet (Openings, about 40 μm)

—Fine Bubble Creating Part—

It was manufactured according to FIG. 8A.

An inner cylinder of a double cylinder was fixed on a rotation axis thereof and was rotated by a rotation driving motor that is not shown in the figures. The material of the double cylinder was a PET resin.

The inner diameter d1 and length L of an outer cylinder were 10 mm and 120 mm, respectively, and the outer diameter d2 and length of the inner cylinder were 8 mm and 100 mm, respectively. The number of rotation R was variable in the range of 1,000 rpm to 2,000 rpm.

—Fixation Fluid Providing Part—

It was manufactured according to FIG. 10. There was provided a configuration such that the fine bubble creating part for creating fine bubbles, as described above, was used to manufacture a bubbly fixation fluid which was provided to a fluid film thickness controlling blade. Two cases were conducted where the gap between the fluid film thickness controlling blade and the application roller was either 25 μm or 40 μm.

Pressurizing roller: aluminum roller (ϕ 30 mm)

Application roller: SUS roller baking-finished with a PFA resin (ϕ 30 mm)

Fluid film thickness controlling blade: SUS sheet

Paper sheet delivery rate: 150 mm/s

Application of load between the pressurizing roller and the application roller: 10 N on one side thereof <Experimental Results>

A bubbly fixation fluid having fine bubbles with a bubble diameter of 5 μm-30 μm could be supplied from a fluid ejection port to the application roller at 1 second after a fixation liquid passed through the large bubble creating part for creating large bubbles and the fine-bubble creating part for making the bubbles be fine while the liquid fixation fluid was pumped up from a fixation liquid container and passed through a fluid flow channel by driving a fluid delivery pump at the timing when a PPC paper sheet (Ricoh T-6200) on which a unfixed color toner image was formed was inserted into a fixation device by using an electrohotographic printer (Ipsio Color CX 8800 produced by Ricoh Company, Ltd.).

SPECIFIC EXAMPLE 2

<Formulation of a Fixation Fluid>

—Liquid Containing a Softening Agent—

Dilution solvent: Ion-exchanged water, 65 wt %

Softening agent: diethoxyethyl succinate (Croda Incorporated, Croda DES), 10 wt %

Thickening agent: propylene glycol, 10 wt %

Bubble increasing agent: coconut oil fatty acid diethanolamide (COCAMIDE DEA), 2 wt %

Bubbling agents:

potassium palmitate, 5 wt % potassium myristate, 3 wt % potassium stearate, 2 wt %

Dispersing agents:

POE (20) lauryl sorbitan (Kao Corporation, Leodol TW-S120V), 2 wt %

Polyethylene glycol monostearate (Kao Corporation, EMANON 3199), 1 wt %

Additionally, the dispersing agents were used to increase the solubility of the softening agent in the dilution solvent. First, at the component ratios described above, mixing and agitation were conducted except the softening agent at a liquid temperature of 120° C. so as to manufacture a solution. Then, the softening agent was mixed and a fixation liquid (original liquid before bubbling) in which the softening agent was dissolved was manufactured by using an ultrasonic homogenizer.

<Application Device>

—Large Bubble Creating Part—

It was manufactured according to FIG. 6.

Container for the liquid fixation fluid described above: Bottle made of a PET resin Fluid delivery pump: Tube pump (Tube inner diameter, 2 mm: Tube material, a silicone rubber)

Delivery flow channel: Silicone rubber tube with an inner diameter of 2 mm

Agitation wing for creating large bubbles: Six wings (1 mm×3 mm) with a diameter of 10 mm were rotated at 100 rpm.

—Fine Bubble Creating Part—

It was manufactured according to FIG. 8A.

An inner cylinder of a double cylinder was fixed on a rotation axis thereof and was rotated by a rotation driving motor that is not shown in the figures. The material of the double cylinder was a PET resin. The inner diameter d1 and length L of an outer cylinder were 10 mm and 120 mm, respectively, and the outer diameter d2 and length of the inner cylinder were 8 mm and 100 mm, respectively. The number of rotation R was variable in the range of 1,000 rpm to 2,000 rpm.

—Fixation Fluid Providing Part—

It was manufactured according to FIG. 10. There was provided a configuration such that the fine bubble creating part for creating fine bubbles, as described above, was used to manufacture a bubbly fixation fluid which was provided to a fluid film thickness controlling blade. Two cases were conducted where the gap between the fluid film thickness controlling blade and the application roller was either 25 μm or 40 μm.

Pressurizing roller: aluminum roller (ϕ 30 mm)

Application roller: SUS roller baking-finished with a PFA resin (ϕ30 mm)

Fluid film thickness controlling blade: SUS sheet

Paper sheet delivery rate: 150 mm/s

Application of load between the pressurizing roller and the application roller: 10 N on one side thereof <Experimental Results>

A bubbly fixation fluid having fine bubbles with a bubble diameter of 5 μm-30 μm could be supplied from a fluid ejection port to the application roller at 3 seconds after a fixation liquid passed through the large bubble creating part for creating large bubbles and the fine bubble creating part for making the bubbles be fine while the liquid fixation fluid was pumped up from a fixation liquid container and passed through a fluid flow channel by driving a fluid delivery pump at the timing when a PPC paper sheet (Ricoh T-6200) on which a unfixed color toner image was formed was inserted into a fixation device by using an electrohotographic printer (Ipsio Color CX 8800 produced by Ricoh Company, Ltd.).

SPECIFIC EXAMPLE 3

<Formulation of a Fixation Fluid>

—Liquid Containing a Softening Agent—

Dilution solvent: Ion-exchanged water, 65 wt %

Softening agent: diethoxyethyl succinate (Croda Incorporated, Croda DES), 10 wt %

Thickening agent: propylene glycol, 10 wt %

Bubble increasing agent: coconut oil fatty acid diethanolamide (COCAMIDE DEA), 2 wt %

Bubbling agents:

potassium palmitate, 5 wt % potassium myristate, 3 wt % potassium stearate, 2 wt %

Dispersing agents:

POE (20) lauryl sorbitan (Kao Corporation, Leodol TW-S120V), 2 wt %

Polyethylene glycol monostearate (Kao Corporation, EMANON 3199), 1 wt %

Additionally, the dispersing agents were used to increase the solubility of the softening agent in the dilution solvent. First, at the component ratios described above, mixing and agitation were conducted except the softening agent at a liquid temperature of 120° C. so as to manufacture a solution. Then, the softening agent was mixed and a fixation liquid (original liquid before bubbling) in which the softening agent was dissolved was manufactured by using an ultrasonic homogenizer.

<Application Device>

—Large Bubble Creating Part—

It was manufactured according to FIG. 7.

Container for the liquid fixation fluid described above: Bottle made of a PET resin Fluid delivery pump: Tube pump (Tube inner diameter, 2 mm: Tube material, a silicone rubber)

Delivery flow channel: Silicone rubber tube with an inner diameter of 2 mm

Air bubbling part for creating large bubbles: Air was injected at a pressure of 0.01 Pa from an air pump.

—Fine Bubble Creating Part—

It was manufactured according to FIG. 8A.

An inner cylinder of a double cylinder was fixed on a rotation axis thereof and was rotated by a rotation driving motor that is not shown in the figures. The material of the double cylinder was a PET resin. The inner diameter d1 and length L of an outer cylinder were 10 mm and 120 mm, respectively, and the outer diameter d2 and length of the inner cylinder were 8 mm and 100 mm, respectively. The number of rotation R was variable in the range of 1,000 rpm to 2,000 rpm.

—Fixation Fluid Providing Part—

It was manufactured according to FIG. 10. There was provided a configuration such that the fine bubble creating part for creating fine bubbles, as described above, was used to manufacture a bubbly fixation fluid which was provided to a fluid film thickness controlling blade. Two cases were conducted where the gap between the fluid film thickness controlling blade and the application roller was either 25 μm or 40 μm.

Pressurizing roller: aluminum roller (ϕ 30 mm)

Application roller: SUS roller baking-finished with a PFA resin (+ 30 mm)

Fluid film thickness controlling blade: SUS sheet

Paper sheet delivery rate: 150 mm/s

Application of load between the pressurizing roller and the application roller: 10 N on one side thereof <Experimental Results>

A bubbly fixation fluid having fine bubbles with a bubble diameter of 5 μm-30 μm could be supplied from a fluid ejection port to the application roller at 2 seconds after a fixation liquid passed through the large bubble creating part for creating large bubbles and the fine bubble creating part for making the bubbles be fine while the liquid fixation fluid was pumped up from a fixation liquid container and passed through a fluid flow channel by driving a fluid delivery pump at the timing when a PPC paper sheet (Ricoh T-6200) on which a unfixed color toner image was formed was inserted into a fixation device by using an electrohotographic printer (Ipsio Color CX 8800 produced by Ricoh Company, Ltd.).

SPECIFIC EXAMPLE 4

<Formulation of a Fixation Fluid>

—Liquid Containing a Softening Agent—

Dilution solvent: Ion-exchanged water, 65 wt %

Softening agent: diethoxyethyl succinate (Croda Incorporated, Croda DES), 10 wt %

Thickening agent: propylene glycol, 10 wt %

Bubble increasing agent: coconut oil fatty acid diethanolamide (COCAMIDE DEA), 2 wt %

Bubbling agents:

potassium palmitate, 5 wt % potassium myristate, 3 wt % potassium stearate, 2 wt %

Dispersing agents:

POE (20) lauryl sorbitan (Kao Corporation, Leodol TW-S120V), 2 wt %

Polyethylene glycol monostearate (Kao Corporation, EMANON 3199), 1 wt %

Additionally, the dispersing agents were used to increase the solubility of the softening agent in the dilution solvent. First, at the component ratios described above, mixing and agitation were conducted except the softening agent at a liquid temperature of 120° C. so as to manufacture a solution. Then, the softening agent was mixed and a fixation liquid (original liquid before bubbling) in which the softening agent was dissolved was manufactured by using an ultrasonic homogenizer.

<Application Device>

—Bubbly Fixation Fluid Producing Part—

It was manufactured according to FIG. 4.

Container for the liquid fixation fluid described above: Bottle made of a PET resin Fluid delivery pump: Tube pump (Tube inner diameter, 2 mm: Tube material, a silicone rubber)

Delivery flow channel: Silicone rubber tube with an inner diameter of 2 mm

Agitation wing for creating bubbles: Six wings with a diameter of 10 mm (1 mm×3 mm)

Process for creating large bubbles:

Agitation with the wings at 500 rpm for 2 seconds

Process for dividing large bubbles:

Agitation with the wings at 4,000 rpm for 2 seconds

—Fixation Fluid Providing Part—

It was manufactured according to FIG. 10. There was provided a configuration such that the bubbly fixation fluid producing part for creating fine bubbles, as described above, was used to manufacture a bubbly fixation fluid which was provided to a fluid film thickness controlling blade. Two cases were conducted where the gap between the fluid film thickness controlling blade and the application roller was either 25 μm or 40 μm.

Pressurizing roller: aluminum roller (+ 30 mm)

Application roller: SUS roller baking-finished with a PFA resin (ϕ 30 mm)

Fluid film thickness controlling blade: SUS sheet

Paper sheet delivery rate: 150 mm/s

Application of load between the pressurizing roller and the application roller: 10 N on one side thereof <Experimental Results>

A bubbly fixation fluid having fine bubbles with a bubble diameter of 5 μm-30 μm could be supplied from a fluid ejection port to the application roller at 5 seconds after the process for creating large bubbles and the process for dividing the large bubbles into fine bubbles were conducted while the liquid fixation fluid was pumped up from a fixation liquid container and passed through a fluid flow channel by driving a fluid delivery pump at the timing when a PPC paper sheet (Ricoh T-6200) on which a unfixed color toner image was formed was inserted into a fixation device by using an electrohotographic printer (Ipsio Color CX 8800 produced by Ricoh Company, Ltd.).

APPENDIX

Typical embodiments (1) to (30) of the present invention are described below.

Embodiment (1) is a bubble creating method configured to create a bubble with a desired bubble diameter from a liquid capable of being bubbly, characterized by having a first bubble creating step of producing a bubbly fluid containing a bubble with a diameter larger than a desired bubble diameter by involving a gas in a liquid and agitating them and a second bubble creating step of producing a bubbly fluid containing a bubble with a desired diameter by applying a shear to the bubbly fluid containing a bubble with a diameter larger than a desired bubble diameter which is produced by the first bubbly fixation fluid producing step.

According to embodiment (1) above, a bubbly fluid with a bubble having a desired diameter may be produced during a short time period.

Embodiment (2) is a bubble creating method configured to create a bubble with a desired bubble diameter from a liquid capable of being bubbly, characterized by applying a shear to a preliminarily produced bubbly fluid containing a bubble with a diameter larger than a desired bubble diameter so as to produce bubbly fluid containing a bubble with a desired diameter.

According to embodiment (2) above, a bubbly fluid with a bubble having a desired diameter may be produced during a shorter time period.

Embodiment (3) is a bubble creating device configured to create a bubble with a desired bubble diameter from a liquid capable of being bubbly, characterized by having a first bubble creating part configured to produce a bubbly fluid containing a bubble with a diameter larger than a desired bubble diameter by involving a gas in a liquid and agitating them and a second bubble creating part configured to produce a bubbly fluid containing a bubble with a desired diameter by applying a shear to the bubbly fluid containing a bubble with a diameter lager than a desired bubble diameter which is produced by the first bubble creating part.

According to embodiment (3) above, a bubbly fluid with a bubble having a desired diameter may be produced during a short time period.

Embodiment (4) is the bubble creating device according to embodiment (3) above, characterized in that the first bubble creating part is provided with a wing-type agitation member having a agitation wing and a driving part configured to rotate the wing-type agitation member, and a liquid is stirred by the wing-type agitation member that is rotated by the driving part so as to involve a gas in the liquid.

According to embodiment (4) above, a bubbly fluid containing a bubble with a large diameter may be produced and/or a large bubble may be produced stably by means of a simple configuration during a short time period.

Embodiment (5) is the bubble creating device according to embodiment (3) above, characterized in that the first bubble creating part is provided with a wing-type agitation member having an agitation wing, a driving part configured to rotate the wing-type agitation member, and a gas injecting part configured to inject a gas into a liquid, and a liquid into which a gas is injected by the gas injecting part is stirred by the wing-type agitation member that is rotated by the driving part so as to involve the gas in the liquid.

According to embodiment (5) above, a bubbly fluid containing a bubble with a large diameter may be produced and/or a large bubble may be produced stably by means of a simple configuration during a short time period.

Embodiment (6) is the bubble creating device according to embodiment (3) above, characterized in that the first bubble creating part is provided with an open-cell porous member through which a liquid mixed with a gas is passed in order to involve the gas in the liquid while the gas is mixed with the liquid.

According to embodiment (6) above, a liquid mixed with a gas may be passed through the open-cell porous member to produce a bubbly fluid containing a bubble with a large diameter and/or a large bubble may be produced stably by means of a simple configuration during a short time period.

Embodiment (7) is the bubble creating device according to embodiment (3) above, characterized in that the first bubble creating part is provided with a bubbling part configured to conduct bubbling so that a gas is injected into a liquid so as to involve the gas in the liquid.

According to embodiment (7) above, a bubbly fluid containing a bubble with a large diameter may be produced by injecting a gas into a liquid and conduct bubbling by using the bubbling part and/or a large bubble may be produced stably by means of a simple configuration during a short time period.

Embodiment (8) is a bubble creating device configured to create a bubble with a desired bubble diameter from a liquid capable of being bubbly, characterized by having a bubble creating part configured to produce a bubbly fluid containing a bubble with a desired diameter by applying a shear to a preliminarily produced bubbly fluid containing a bubble with a diameter larger than a desired bubble diameter.

According to embodiment (8) above, a bubbly fluid with a bubble having a desired diameter may be produced during a shorter time period.

Embodiment (9) is the bubble creating device according to embodiment (3) or (8) above, characterized in that the second bubble creating part or the bubble creating part has a closed double cylinder structure having an inner cylinder capable of rotating axially and an outer cylinder containing the inner cylinder, and a fluid passes though a fluid channel formed in a gap between an outer surface of the inner cylinder rotating axially and an inner surface of the outer cylinder while a shear is applied to the fluid, so as to produce a bubbly fluid containing a bubble with a desired diameter.

According to embodiment (9) above, a bubble with a desired bubble diameter may be produced stably by means of a simple configuration during a short time period.

Embodiment (10) is the bubble creating device according to embodiment (9) above, characterized by providing a peripheral surface of the inner cylinder with a channel.

According to embodiment (10) above, a bubble with a desired bubble diameter may be produced by further increasing a shear and increasing a delivery rate of a bubble during a shorter time period.

Embodiment (11) is the bubble creating device according to embodiment (10) above, characterized in that the channel is in a spiral shape having an orientation of fluid delivery.

According to embodiment (11) above, a bubble with a desired bubble diameter may be produced by further increasing a shear and increasing a delivery rate of a bubble during a shorter time period.

Embodiment (12) is the bubble creating device according to embodiment (3) or (8) above, characterized in that the second bubble creating part or the bubble creating part has a closed double cylinder structure having an inner cylinder and an outer cylinder containing the inner cylinder, and the inner cylinder vibrates in longitudinal directions thereof and relative to the outer cylinder so as to pass a fluid through a fluid channel formed in a gap between an outer surface of the inner cylinder and an inner surface of the outer cylinder while a shear is applied to the fluid so as to produce a bubbly fluid containing a bubble with a desired diameter.

According to embodiment (12) above, a bubble with a desired bubble diameter may be produced stably by means of a simple configuration during a short time period.

Embodiment (13) is a bubble creating device configured to create a bubble with a desired bubble diameter from a liquid capable of being bubbly, characterized by having a bubble creating part configured to produce a bubbly fluid containing a bubble with a desired diameter by varying a shear applied to a liquid.

According to embodiment (13) above, a bubbly fluid containing a bubble with a desired diameter may be produced in a sequential process while a shear may be changed by one mechanism.

Embodiment (14) is the bubble creating device according to embodiment (13) above, characterized in that the bubble creating part has a closed double cylinder structure having an inner cylinder capable of rotating axially and an outer cylinder containing the inner cylinder, and a fluid passes through a fluid channel formed in a gap between an outer surface of the inner cylinder rotating axially and an inner surface of the outer cylinder while a shear is applied to the fluid and a number of rotation of the inner cylinder varies simultaneously so as to produce a bubbly fluid containing a bubble with a desired diameter.

According to embodiment (14) above, a bubbly fluid containing a bubble with a desired diameter may be produced in a sequential process while a shear may be changed by one mechanism.

Embodiment (15) is the bubble creating device according to embodiment (13) above, characterized in that the bubble creating part is provided with a first wing-type agitation member capable of rotating and having a first agitation wing configured to produce a bubbly fluid containing a bubble with a diameter larger than a desired bubble diameter, a second wing-type agitation member having a second agitation wing configured to produce a bubbly fluid containing a bubble with a desired diameter from the bubbly fluid containing a bubble with a diameter larger than a desired bubble diameter, and a driving part configured to rotate the first and second wing-type agitation members, and a fluid is stirred by the first and second wing-type agitation members that are rotated by the driving part so as to involve a gas in a liquid and to produce a bubbly fluid containing a bubble with a desired diameter.

According to embodiment (15) above, a bubbly fluid containing a bubble with a desired diameter may be produced in a sequential process while a shear may be changed by one mechanism.

Embodiment (16) is a bubbly fixation fluid producing method characterized in that the fluid in the bubble creating method according to embodiment (1) or (2) above is a fixation fluid which contains a softening agent configured to soften a fine particle containing a resin by dissolving or swelling at least a portion of the resin.

According to embodiment (16) above, a bubbly fixation fluid containing a bubble with a desired diameter may be produced by involving a gas in the fixation fluid and agitating them so as to produce a bubbly fixation fluid containing a bubble with a diameter larger than a desired bubble diameter and apply a shear to the produced bubbly fixation containing a bubble with a diameter larger than a desired bubble diameter and/or a bubbly fixation fluid containing a bubble having a desired diameter may be produced during a short time period.

Embodiment (17) is a bubbly fixation fluid producing device characterized in that the fluid in the bubble creating device according to any of claims 3 to 15 is a fixation fluid which contains a softening agent configured to soften a fine particle containing a resin by dissolving or swelling at least a portion of the resin.

According to embodiment (17) above, a bubbly fixation fluid containing a bubble with a desired diameter may be produced by applying a shear to a preliminarily produced bubbly fixation fluid containing a bubble with a diameter larger than a desired bubble diameter and/or a bubbly fixation fluid containing a bubble having a desired diameter may be produced during a shorter time period.

Embodiment (18) is a fixation method configured to fix a resin fine particle on a medium by providing a bubbly fixation fluid on the resin fine particle on the medium which fluid contains a softening agent configured to soften a fine particle containing a resin by dissolving or swelling at least a portion of the resin, characterized by providing the bubbly fixation fluid containing a bubble with a desired diameter which is produced by the bubbly fixation fluid producing method according to embodiment (16) above on the resin fine particle on the medium.

According to embodiment (18) above, offset to a bubbly fixation fluid providing member may be prevented whereby it may be possible to conduct fixation with application of a small amount thereof, excellent fixation responsiveness, and prevention of curling of a medium such as a paper sheet and without disturbance of a resin fine particle on the medium.

Embodiment (19) is a fixation device configured to fix a resin fine particle on a medium by providing a bubbly fixation fluid on the resin fine particle on the medium which fluid contains a softening agent configured to soften a fine particle containing a resin by dissolving or swelling at least a portion of the resin, characterized by having a bubbly fixation fluid providing part configured to provide the bubbly fixation fluid containing a bubble with a desired diameter which is produced by the bubbly fixation fluid producing device according to embodiment (17) above on the resin fine particle on the medium.

According to embodiment (19) above, offset to a bubbly fixation fluid providing member may be prevented whereby it may be possible to conduct fixation with application of a small amount thereof, excellent fixation responsiveness, and prevention of curling of a medium such as a paper sheet and without disturbance of a resin fine particle on the medium.

Embodiment (20) is a fixation fluid configured to fix a resin fine particle on a medium by producing a fixation fluid in a bubbly form and providing the produced bubbly fixation fluid on the resin fine particle on the medium, characterized in that the fixation fluid contains a softening agent configured to soften the resin fine particle by dissolving or swelling at lease a portion of the resin fine particle, water, and a foaming agent including a salt of aliphatic acid.

According to embodiment (20) above, a bubble stability may be drastically improved, whereby a bubble may be divided stably without babble vanishing when a large bubble may be divided, and reliability may be improved.

Embodiment (21) is the fixation fluid according to embodiment (20) above, characterized in that the softening agent comprises an aliphatic ester.

Embodiment (22) is the fixation fluid according to embodiment (21) above, characterized in that the aliphatic ester comprises a saturated aliphatic ester.

Embodiment (23) is the fixation fluid according to embodiment (22) above, characterized in that the saturated aliphatic ester comprises a compound represented by a general formula of R1COOR2, wherein R1 is an alkyl group whose carbon number is equal to or more than 11 and equal to or less than 14 and R2 is an alkyl group whose carbon number is equal to or more than 1 and equal to or less than 6.

Embodiment (24) is the fixation fluid according to embodiment (21) above, characterized in that the aliphatic ester comprises an aliphatic dicarboxylic acid ester.

Embodiment (25) is the fixation fluid according to embodiment (24) above, characterized in that the aliphatic dicarboxylic acid ester comprises a compound represented by a general formula of $R3(COOR4)_2$, wherein R3 is an alkylene group whose carbon number is equal to or more than 3 and equal to or less than 8 and R4 is an alkyl group whose carbon number is equal to or more than 3 and equal to or less than 5.

Embodiment (26) is the fixation fluid according to embodiment (21) above, characterized in that the aliphatic ester comprises dialkoxyalkyl aliphatic dicarboxylate.

Embodiment (27) is the fixation fluid according to embodiment (26) above, characterized in that the dialkoxyalkyl aliphatic dicarboxylate comprises a compound represented by a general formula of $R5(COOR6—O—R7)_2$, wherein R5 is an alkylene group whose carbon number is equal to or more than 2 and equal to or less than 8, R6 is an alkylene group whose carbon number is equal to or more than 2 and equal to or less than 4, and R7 is an alkyl group whose carbon number is equal to or more than 1 and equal to or less than 4.

Embodiment (28) is the fixation fluid according to any of embodiments (20) to (27) above, characterized in that the fixation fluid comprises a monohydric or polyhydric alcohol.

According to embodiment (28) above, curling of a medium such as a paper sheet containing a cellulose may be reduced.

Embodiment (29) is an image forming method characterized by having an image forming step of forming an unfixed toner image on a medium by conducting an electrostatic recording process with a developer comprising a resin fine particle containing a resin and a coloring agent and a fixation step of fixing the unfixed toner image on the medium by providing on the unfixed toner image on the medium a bubbly fixation fluid containing a bubble with a desired diameter which is produced by the bubbly fixation fluid producing method according to embodiment (16) above.

According to embodiment (29) above, an image forming method being a non-heating fixation-type one, having a low electric power consumption, and being excellent in a fixation responsiveness may be provided.

Embodiment (30) is an image forming apparatus characterized by being provided with an image forming part configured to form an unfixed toner on a medium by conducting an electrostatic recording process with a developer comprising a resin fine particle containing a resin and a coloring agent and a fixation part configured to fix the unfixed toner image on the medium by providing on the unfixed toner image on the medium a bubbly fixation fluid containing a bubble with a desired diameter which is produced by the bubbly fixation fluid producing device according to embodiment (17) above.

According to embodiment (30) above, an image forming apparatus may be provided which may conduct fixation of a resin fine particle on a medium quickly without disturbing a fine particle containing a resin such as a toner on a medium such as a paper sheet after application of a fixation fluid on the medium to which the resin fine particle attaches, may conduct fixation of a small amount thereof such that feel of remaining fluid is not provided on a medium, may be a non-heating fixation-type, may have a low electric power consumption, and may be excellent in a fixation responsiveness.

Additionally, according to at least one of typical embodiments (1) to (30) of the present invention, it may be possible to realize prevention of offset of a resin fine particle to a contact providing part at the time of providing contact with a resin fine particle layer and/or provision of a small amount thereof, by using a bubbly fixation fluid. Also, it may be possible to produce a bubbly fixation fluid containing a bubble having a desired diameter from a liquid fixation fluid in a fixation fluid container during an extremely short time period. Furthermore, it may be possible to make a fixation build-up time period from a power-on state or a sleep mode a drastically shortened time period so as to improve the performance of a fixation operation.

Although the embodiment(s) and specific example(s) of the present invention have been specifically described above, the present invention is not limited to the embodiment(s) or specific example(s) and the embodiment(s) and specific example(s) of the present invention can be altered or modified without departing from the spirit or scope of the present invention.

The present application claims the benefit of foreign priority based on Japanese Patent Application No. 2007-029903 filed on Feb. 9, 2007, in Japan, the entire content of which is hereby incorporated by reference.

What is claimed is:

1. A bubbly fluid producing device configured to produce a bubbly fluid containing a bubble with a desired bubble diameter, comprising a first member configured to apply a shear to the bubbly fluid containing a bubble diameter larger than the desired bubble diameter so as to produce the bubbly fluid containing the bubble with the desired bubble diameter, wherein applying the shear is variable.

2. The bubbly fluid producing device as claimed in claim 1, which further comprises a second member configured to agitate a liquid capable of being bubbly such that a gas is involved in the liquid, so as to produce the bubbly fluid containing the bubble with the bubble diameter larger than the desired bubble diameter.

3. The bubbly fluid producing device as claimed in claim 2, wherein the second member comprises a wing-type agitation member having an agitation wing and a driving device configured to rotate the wing-type agitation member.

4. The bubbly fluid producing device as claimed in claim 3, wherein the second member further comprises a gas injection member configured to inject the gas into the liquid.

5. The bubbly fluid producing device as claimed in claim 2, wherein the second member comprises an open-cell porous member configured to mix the gas with the liquid.

6. The bubbly fluid producing device as claimed in claim 2, wherein the second member comprises a bubbling member configured to conduct bubbling such that the gas is involved in the liquid.

7. The bubbly fluid producing device as claimed in claim 1, wherein the first member comprises an inner cylinder capable of rotating around an axis thereof and an outer cylinder containing the inner cylinder and the bubbly fluid containing the bubble with the bubble diameter larger than the desired bubble diameter passes through a gap between an outer surface of the inner cylinder and an inner surface of the outer cylinder.

8. The bubbly fluid producing device as claimed in claim 7, wherein the outer surface of the inner cylinder has a groove.

9. The bubbly fluid producing device as claimed in claim 8, wherein the groove has a spiral shape with a spiral direction in a delivery of the bubbly fluid containing a bubble with a bubble diameter larger than a desired bubble diameter.

10. The bubbly fluid producing device as claimed in claim 7, wherein the inner cylinder vibrates relative to the outer cylinder and in directions of the axis.

11. The bubbly fluid producing device as claimed in claim 7, wherein a number of rotation(s) of the inner cylinder is variable.

12. The bubbly fluid producing device as claimed in claim 1, wherein the first member comprises a wing-type agitation member having an agitation wing and a driving device configured to rotate the wing-type agitation member.

13. The bubbly fluid producing device as claimed in claim 1, wherein the liquid comprises a softening agent configured to soften a particle containing a resin by dissolving or swelling at least one portion of the resin.

14. A bubbly fluid producing device configured to produce a bubbly fluid containing a bubble with a desired bubble diameter, comprising a first member configured to apply a shear to the bubbly fluid containing a bubble diameter larger than the desired bubble diameter so as to produce the bubbly fluid containing the bubble with the desired bubble diameter, wherein the first member includes an inner cylinder capable of rotating around an axis thereof and an outer cylinder containing the inner cylinder and the bubbly fluid containing a bubble with a bubble diameter larger than a desired bubble diameter passes through a gap between an outer surface of the inner cylinder and an inner surface of the outer cylinder, and wherein the inner cylinder vibrates relative to the outer cylinder and in directions of the axis.

15. A bubbly fluid producing device configured to produce a bubbly fluid containing a bubble with a desired bubble diameter, comprising a first member configured to apply a shear to the bubbly fluid containing a bubble diameter larger than the desired bubble diameter so as to produce the bubbly fluid containing the bubble with the desired bubble diameter, wherein the first member includes a wing-type agitation member having an agitation wing and a driving device configured to rotate the wing-type agitation member.

US 7,869,754 B2
29 30

* * * * *